US006258183B1

(12) United States Patent
Onuki et al.

(10) Patent No.: US 6,258,183 B1
(45) **Date of Patent: *Jul. 10, 2001**

(54) MOLDED PRODUCT OF AMORPHOUS METAL AND MANUFACTURING METHOD FOR THE SAME

(75) Inventors: Masahide Onuki, Miki; Jun Nishibayashi, Kobe; Tetsuo Yamaguchi; Haruyoshi Minamiguchi, both of Nishinomiya; Akihisa Inoue, Sendai, all of (JP)

(73) Assignees: Sumitomo Rubber Industries, Ltd., Hyogo; Akihisa Inque, Miyagi, both of (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/131,341

(22) Filed: Aug. 7, 1998

(30) Foreign Application Priority Data

Aug. 8, 1997 (JP) ..... 9-227360
Aug. 8, 1997 (JP) ..... 9-227361
Aug. 8, 1997 (JP) ..... 9-227362

(51) Int. Cl.[7] ..... C22C 45/00

(52) U.S. Cl. ..... 148/403; 148/561; 473/348; 473/349

(58) Field of Search ..... 148/403, 561; 473/348, 349, 350

(56) References Cited

U.S. PATENT DOCUMENTS

| | | | | |
|---|---|---|---|---|
| 5,288,344 | * | 2/1994 | Peker et al. | 148/403 |
| 5,735,975 | * | 4/1998 | Lin et al. | 148/403 |
| 5,797,176 | * | 8/1998 | Rose et al. | 473/350 |
| 5,896,642 | * | 4/1999 | Peker et al. | 148/561 |
| 5,967,904 | * | 10/1999 | Nagai et al. | 473/349 |
| 6,001,032 | * | 12/1999 | Onuki et al. | 473/350 |
| 6,089,992 | * | 7/2000 | Onuki et al. | 473/349 |

* cited by examiner

*Primary Examiner*—George Wyszomierski
(74) *Attorney, Agent, or Firm*—Armstrong, Westerman, Hattori, McLeland & Naughton, LLP

(57) ABSTRACT

A metal material is placed on a lower mold of a press metal mold which has an upper mold and the lower mold not having engagement portions. The metal material is fused by a high energy heat source, and obtained molten metal over a melting point is pressed with the press metal mold and transformed into a predetermined configuration. The molten metal is cooled at a rate over a critical cooling rate simultaneously with or after the transformation, and the molded product of amorphous metal in predetermined configuration is obtained.

8 Claims, 30 Drawing Sheets

MOLDED PRODUCT OF AMORPHOUS METAL AND MANUFACTURING METHOD FOR THE SAME

BACKGROUND OF THE INVENTION

1. Field of the Invention

This invention relates to molded products of amorphous metal and manufacturing method for the same.

2. Description of the Related Art

Conventionally, as methods for manufacturing a molded product of amorphous metal (amorphous alloy), various methods are being proposed. In one of the methods, metal material is melted, rapid-cooled metal (alloy) powder is obtained by rapid cooling solidification of the metal material from the molten state, and the obtained rapid-cooled metal powder is solidified into a predetermined configuration at under a crystallizing temperature and true densified. In another method, molten metal and alloy are solidified with rapid cooling, and a molded product of amorphous metal in a predetermined configuration is directly obtained.

Most of the molded products of amorphous metal obtained by these methods, however, have small mass, and it is difficult to obtain bulk material applicable to a product such as a face of a golf club head. For this reason, although a method for obtaining a molded product of amorphous metal as bulk material by solidification of the rapid-cooled metal powder is also attempted, bulk material having sufficient strength characteristics, such as high strength and high toughness required as a face of a golf club head, etc., cannot be obtained.

And, as shown in FIG. 46A, on a method for making a molded product of amorphous metal in a predetermined configuration by press and rapid cooling of molten metal c (in further detail, a metal material placed on a lower mold b is melted by a high energy heat source, and the obtained molten metal c is pressed and formed into the predetermined configuration) with a press metal mold which consists of an upper mold a and a lower mold b having engagement portion, or with a press mold of which upper mold a and lower mold b each has a vertical face g extending to a parting line, respectively, inventors of the present invention have conducted experiments with repeating much trial and error. However, if the molten metal c is pressed by the upper mold a and the lower mold b, as shown in FIG. 46B and FIG. 47, excessive molten metal c flows in between the vertical face g of the upper mold a and the vertical face g of the lower mold b (a slight aperture d of the engagement portion), the molten metal c in the aperture d is rapidly cooled and becomes solidified flash f, and the flash f is a cause of various bad influences. That is to say, it is revealed that the vertical faces g of the upper mold a and the lower mold b are damaged by the flash f, or "galling" is generated by the flash f, and a product e (the molded product of amorphous metal) of a predetermined configuration and a predetermined thickness dimension h cannot be obtained because the metal mold cannot be closed for the molten metal c flowing into the engagement portion (the aperture d). Further, it is also revealed that the metal mold itself is worn down by the bad closing, and the life span of the metal mold is shortened thereby.

It is therefore an object of the present invention to provide a molded product of amorphous metal having excellent strength characteristics, and manufacturing methods with which the molded product of amorphous metal can be easily made.

BRIEF DESCRIPTION OF THE DRAWINGS

The present invention will be described with reference to the accompanying drawings in which.

DESCRIPTION OF THE PREFERRED EMBODIMENTS

Preferred embodiments of the present invention will now be described with reference to the accompanying drawings.

Figure 1:
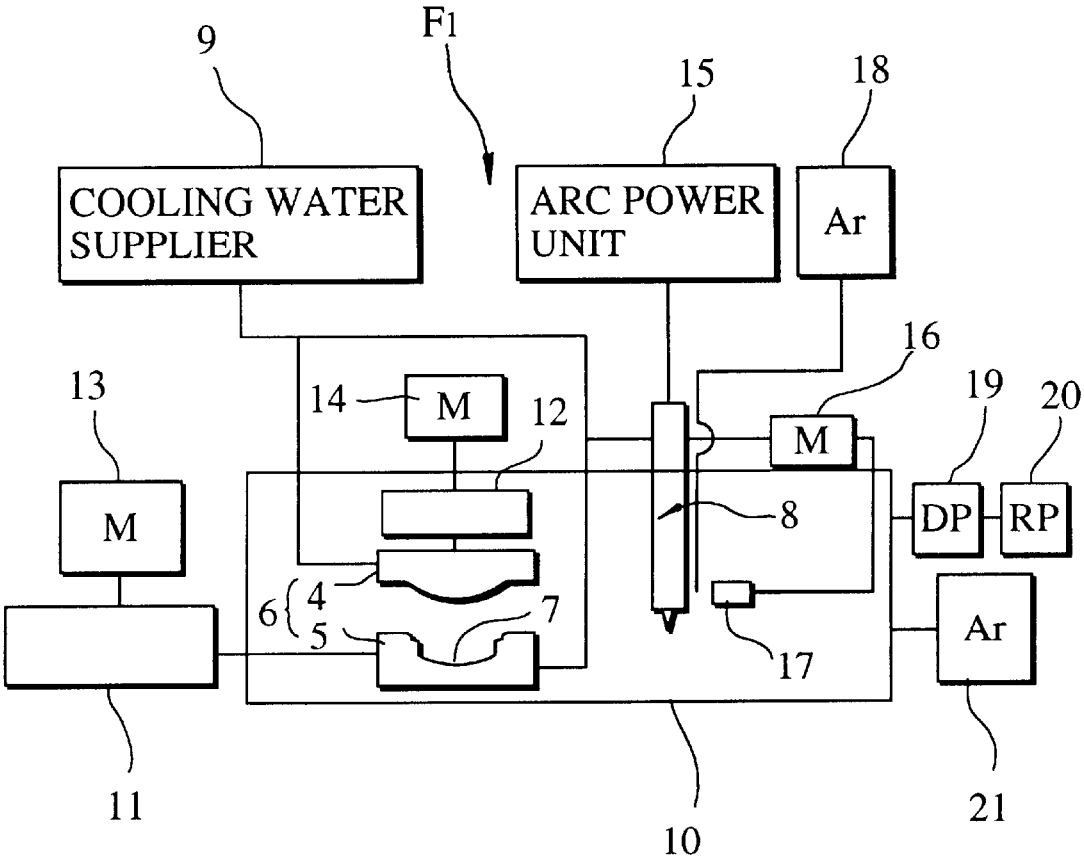
FIG. 1 is an explanatory view of a construction of a manufacturing apparatus which produces a molded product of amorphous metal of the present invention.

FIG. 1 shows a manufacturing apparatus $F_1$ which produces a molded product of amorphous metal of the present invention. The molded product of amorphous metal produced by this manufacturing apparatus $F_1$ is, for example, used as a face body 1 of a wood type golf club head 2 and an iron type golf club head 2 as shown in FIG. 7 through FIG. 10. As the face body 1, a face plate is preferable. FIG. 8 and FIG. 10 show cases that the face body 1 is such a face plate. And, the molded product of amorphous metal of the present invention is characterized by being made with manufacturing methods described below.

Figure 2:
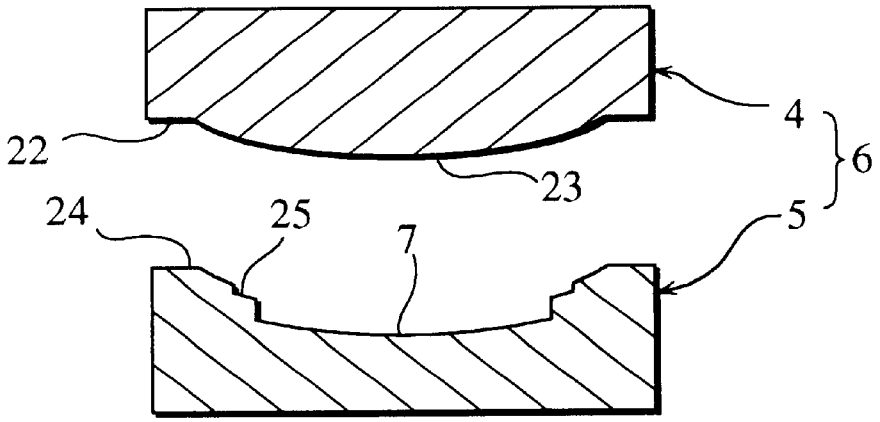
FIG. 2 is a cross-sectional front view showing a press metal mold.

First, the manufacturing apparatus $F_1$ will be described. As shown in FIG. 1 and FIG. 2, the manufacturing apparatus $F_1$ is provided with a press metal mold 6 which consists of an upper mold 4 and a lower mold 5, an arc electrode 8 (a tungsten electrode) for melting a metal material placed on a cavity portion 7 of the lower mold 5, a cooling water supplier 9 which circulates and supplies cool water to the upper mold 4 and the lower mold 5 of the press metal mold 6 and the arc electrode 8, a vacuum chamber 10 which contains the press metal mold 6 and the arc electrode 8, a lower mold moving mechanism 11 which is driven by a motor 13 and moves the lower mold 5 in horizontal direction, and an upper mold moving mechanism 12 which is driven by a motor 14 and moves the upper mold 4 in vertical direction.

As the lower mold moving mechanism 11, which is not restricted, conventional and known translation mechanism and reciprocating mechanism can be used. For example, pneumatic mechanisms, such as a drive screw and traveling nut with ball screw, air cylinder, etc., and oil pressure mechanisms such as an oil hydraulic cylinder, etc., can be appropriately used. And, as the upper mold moving mechanism 12, which is also not restricted, conventional and known press metal mold mechanism, such as an oil pressure mechanism and a pneumatic mechanism, can be used. Further, other cooling media (refrigerant gas, for example) may be used instead of the cooling water.

The arc electrode 8 is connected with an arc power unit 15, and positioned as to be slightly inclined to a depth of the cavity portion 7 of the lower mold 5, and arranged as to be adjusted in direction of X-axis, Y-axis, and Z-axis by a stepping motor 16. And, to keep a space between the metal material on the lower mold 5 and the arc electrode (in Z-axis direction), movement of the arc electrode 8 may be automatically controlled by the stepping motor 16 in response to measurement of the position of the metal material by a semiconductor laser sensor 17. Because, if the space between the arc electrode 8 and the metal material changes the arc becomes unstable, and instability is generated in fusing temperature. And, an exhaust nozzle of coolant gas (Ar gas, for example) may be arranged near an arc generating portion of the arc electrode 8, the coolant gas is blown out of a gas supplier (a gas cylinder) 18, rapid cooling after heating is promoted.

The vacuum chamber 10 having a water cooling jacket made of SUS is connected with an oil diffusion vacuum pump (a diffusion pump) 19 and an oil rotation vacuum pump (a rotary pump) 20 through a vacuum exhaust port for vacuumization, and connected with a gas supplier (a gas cylinder) 21 through an argon gas leading port for replacement with an inert gas after the vacuumization. And, the cooling water supplier 9 cools down the circulating cooling water with coolant, and supplies the cooling water to the upper mold 4, lower mold 5, and the arc electrode 8.

Figure 3:
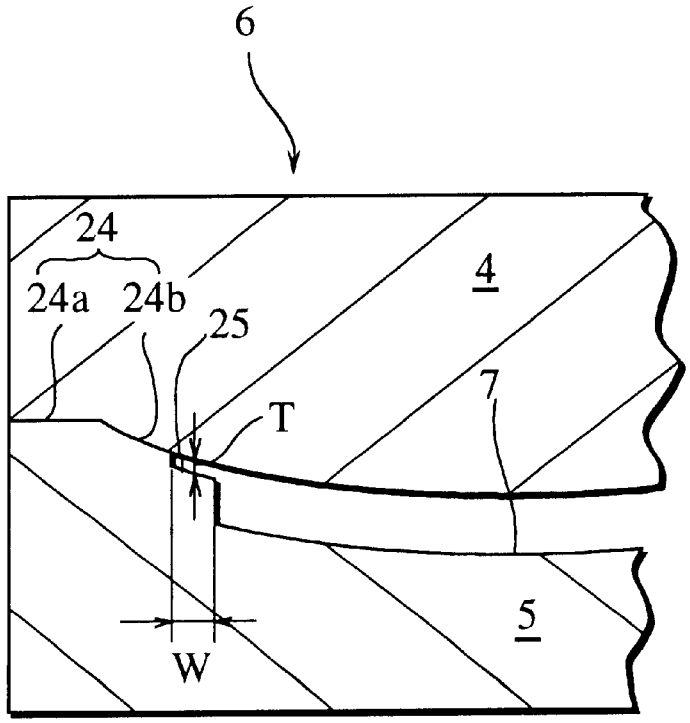
FIG. 3 is a cross-sectional view showing an enlarged principal portion of a press metal mold.

And, as shown in FIG. 2 and FIG. 3, the press metal mold 6 has a configuration without engagement portions. Specifically, the lower face of the upper mold 4 is a smooth face having a plane parting face 22 and a convex curved face 23, and the radius of curvature of the convex curved face 23 is arranged to be over 5 inches. And, a part of the convex curved face 23 also comprises the parting face.

The lower mold 5 has the concave-curved cavity portion 7 of which radius of curvature is 5 to 100 inches, and a parting face 24 (consists of a plane portion 24*a* and a concave curved face 24*b*) which contacts the parting face 22 and a part of the convex curved face 23. And, a gap 25 of which gap dimension T is 0.1 mm to 3.0 mm and of which width dimension W is 4.0 mm to 20.0 mm is formed on a part of the lower mold 5 along the parting face 24 (the concave curved face 24*b*) in a closed state of the press metal mold 6, and excessive molten metal flows into the gap 25 in molding process. The configuration of the press metal mold 6, which is not restricted to this configuration described above, may be configurations shown in FIG. 11 through FIG. 14 which will be described later in detail.

Next, a manufacturing method for the molded product of amorphous metal will be described.

Figure 4A:
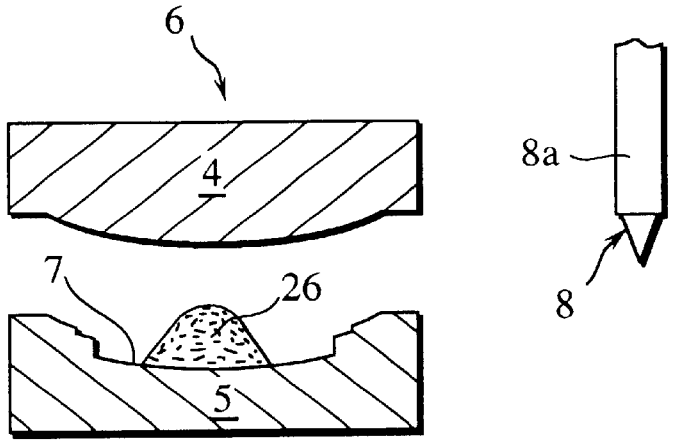
FIG. 4A is a first explanatory view showing a production process of the molded product of amorphous metal with the manufacturing apparatus.

First, as shown in FIG. 1 and FIG. 4A, a metal material 26 is placed on the cavity portion 7 of the lower mold 5 set below the upper mold 4. As this metal material 26, ternary system alloys, such as Ln (lanthanoids)-Al—TM (transition metals), Mg—Ln—TM, Zr—Al—TM, etc., Zr series alloys such as Zr—Al—Ni—Cu, Zr—Ti—Al—Ni—Cu, Zr—Nb—Al—Ni—Cu, etc., and alloys in which almost all elements may be combined including multinary (over quaternary) system alloys, are used. To facilitate the rapid fusing by a high energy heat source (the arc electrode 8 and the arc power unit 15 in the drawing figures), although it is preferable to use powder or pellet of the alloys, metal material of wire, belt, bar, and lump may be used as far as rapid fusing is possible.

Second, the arc electrode 8 is positioned in X-axis, Y-axis, and Z-axis direction by the laser sensor 17 and the stepping motor 16 through an adapter 8*a*, and the space (distance in Z-axis direction) between the arc electrode 8 and the metal material 26 is set to be a predetermined value.

And, inside of the chamber 10 is made a high vacuum, for example, of $5\times10^{-4}$Pa (using a liquid nitrogen trap), with the oil diffusion vacuum pump 19 and the oil rotation vacuum pump 20, then, the contents inside of the chamber 10 are replaced with argon gas by supply of argon gas from the Ar gas supplier 21. And, the upper mold 4, lower mold 5, and the arc electrode 8 are cooled by the cooling water from the cooling water supplier 9.

After the preparation described above, as shown in FIG. 1 and FIGS. 4A and 4B, the lower mold 5 is moved in horizontal direction (a direction shown by arrow A) by the lower mold moving mechanism 11 driven by the motor 13, and stopped below the arc electrode 8. And, the arc power unit 15 is switched on, plasma arc 27 is generated from a tip end of the arc electrode 8 to the metal material 26, and molten metal 28 is formed by fusing the metal material 26 completely.

Figure 4B:
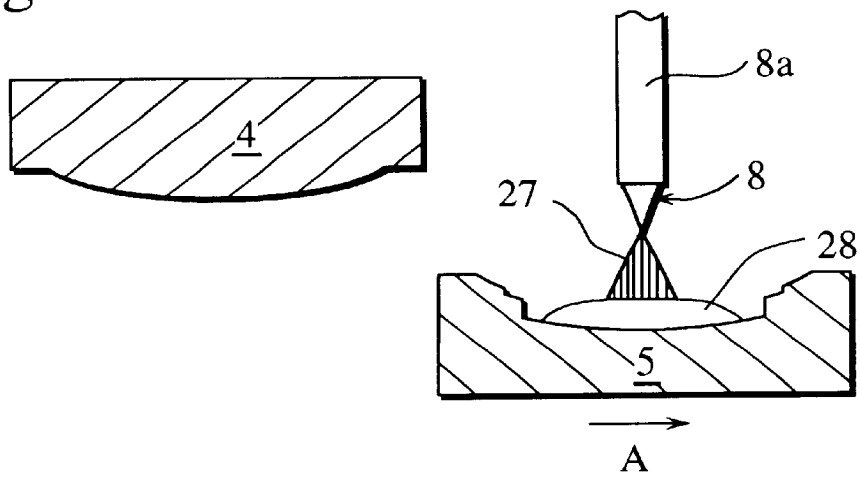
FIG. 4B is a second explanatory view showing the production process of the molded product of amorphous metal with the manufacturing apparatus.
Figure 4C:
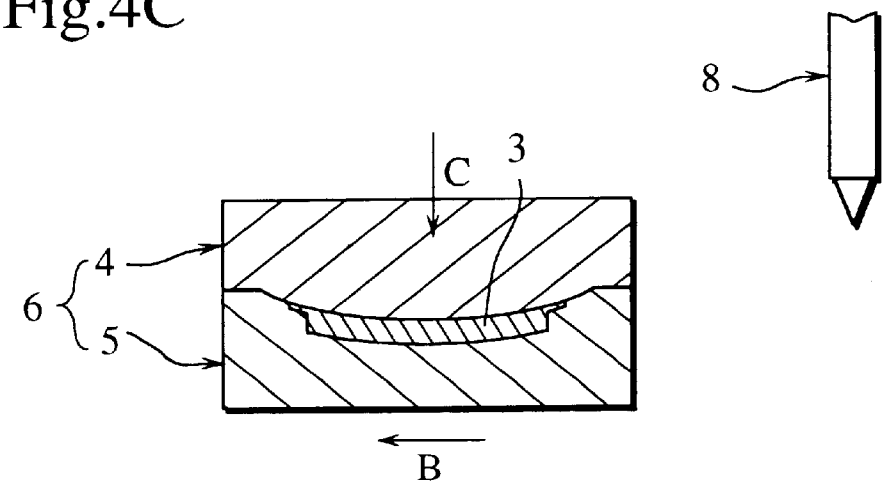
FIG. 4C is a third explanatory view showing the production process of the molded product of amorphous metal with the manufacturing apparatus.

Then, as shown in FIG. 1 and FIGS. 4B and 4C, the arc power unit 15 is switched off, and the plasma arc 27 is put off. And, the lower mold 5 is quickly moved (in a direction shown by arrow B) to a position below the upper mold 4, the upper mold 4 is moved down (in a direction shown with an arrow C) by the upper mold moving mechanism 12 driven by the motor 14, and the obtained molten metal 28 of over the melting point is pressed by the upper mold 4 and the lower mold 5 and transformed into a predetermined configuration. The molten metal 28 is cooled at over a critical cooling rate by the cooled press metal mold 6 simultaneously with, or after, the transformation, and the molten metal is rapidly solidified and a molded product 3 of the predetermined configuration is made thereby.

Figure 5:
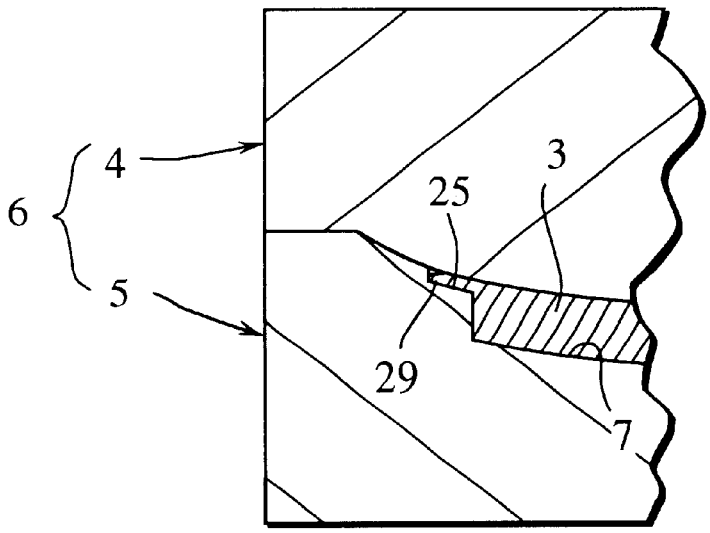
FIG. 5 is a cross-sectional view showing an enlarged principal portion of a closed state of the press metal mold.

As shown in FIG. 5, in molding of the molded product 3, excessive molten metal flows into the former-described gap 25 formed on the lower mold 5, and becomes flash 29 of the molded product 3 with cooling solidification. That is to say, the press metal mold 6 does not have engagement portions, the gap 25 that absorbs the excessive molten metal is provided, the flow of the molten metal is not stopped during the pressurization by the press metal mold 6, and a synergistic effect that the molded product 3 of the predetermined thickness is certainly obtained without interruption of closing the press metal mold 6 is generated. And, the press metal mold is not damaged by the flash 29, and the press metal mold 6 has high durability.

The molded product 3 of thin plate shape made with the method described above is a molded product of amorphous metal (amorphous alloy) that is cooled and solidified uniformly, not mixed with crystal phase caused by non-uniform solidification and non-uniform nucleation, and excellent in strength characteristics, such as high strength and high toughness, without defects, such as cold shut, because the molten metal of over the melting point is transformed into a predetermined configuration and cooled simultaneously. That is to say, after the fusing of the metal material, the obtained molten metal is pressed and transformed without contacts of cooling surfaces of the molten metal under the melting point.

Figure 6A:
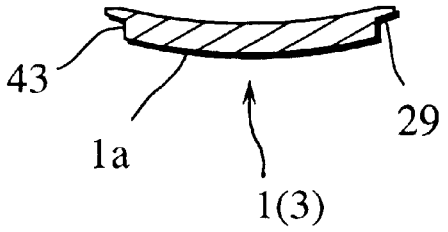
FIG. 6A is a cross-sectional view showing a state before finishing of the molded product of amorphous metal of the present invention.
Figure 6B:
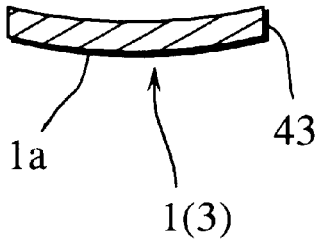
FIG. 6B is a cross-sectional view showing a production state of the molded product of amorphous metal of the present invention.

FIG. 6A shows the above-described molded product 3 taken out of the press metal mold 6. The molded product 3 is, in this preferred embodiment, a face body (face plate) 1 of a golf club head. The face body 1 has the flash 29 on a peripheral edge 43, the flash 29 is cut, and the face body 1 is finished as a product. Numeral 1*a* represents a face of convex curve.

As described with reference to FIG. 3 and FIG. 5, a space in which the molten metal is sufficiently absorbed is prepared and cutting work of the flash 29 becomes easy for the arrangement that the gap dimension T of the gap is 0.1 mm to 3.0 mm and the width dimension W is 4. 0 mm to 20.0 mm. If the gap dimension T is less than 0.1 mm, the molten metal hardly flows into the gap 25, and if the gap dimension T is over 3. 0 mm, the flash 29 becomes thick and difficult to cut. And, if the width dimension W is less than 4.0 mm, the molten metal is not absorbed sufficiently, and if the width dimension is over 20.0 mm, the metal mold becomes large.

And, the face body 1 after the molding used for a wood type golf club head does not need working for bulge adjustment, since the radius of curvature of the lower mold 5 forming the face 1*a* is arranged to be 5 inches to 100 inches, and the radius of curvature of the upper mold 4 is arranged to be more than 5 inches. If the radius of curvature of the lower mold 5 is less than 5 inches, after-working, such as cutting and polishing for diminishing the bulge of the face body 1 becomes necessary, and if the radius of curvature of the lower mold 5 is more than 100 inches, after-working for adding the bulge becomes necessary.

Figure 7:
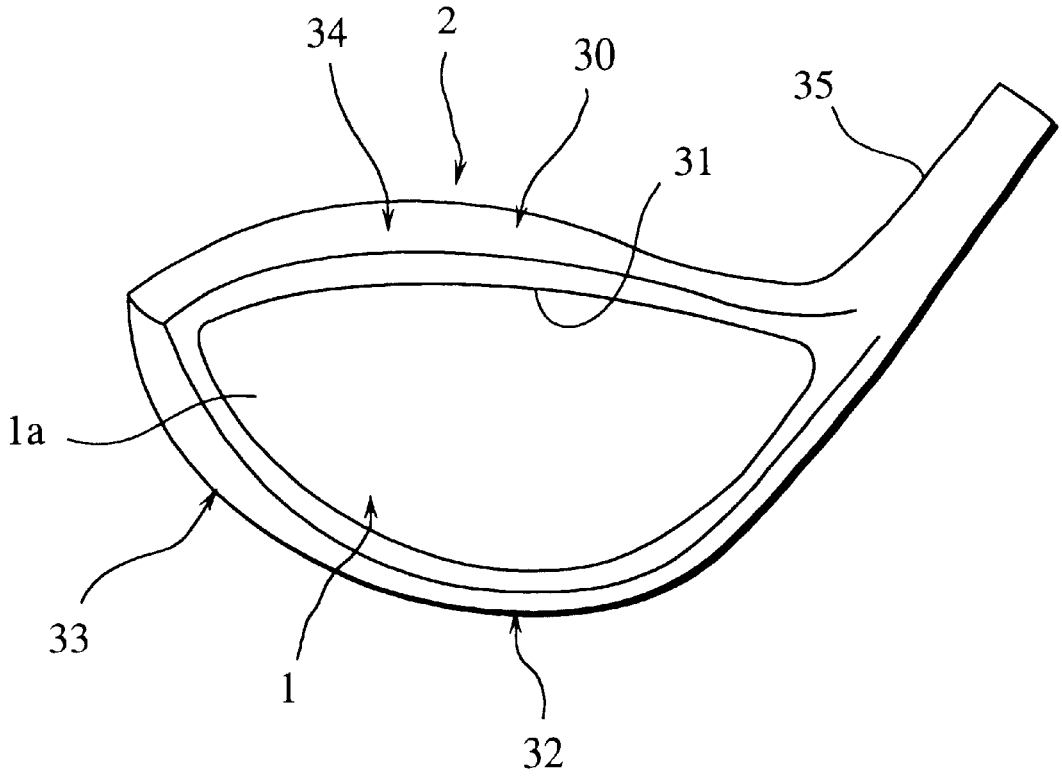
FIG. 7 is a front view showing a wood type golf club head.
Figure 8:
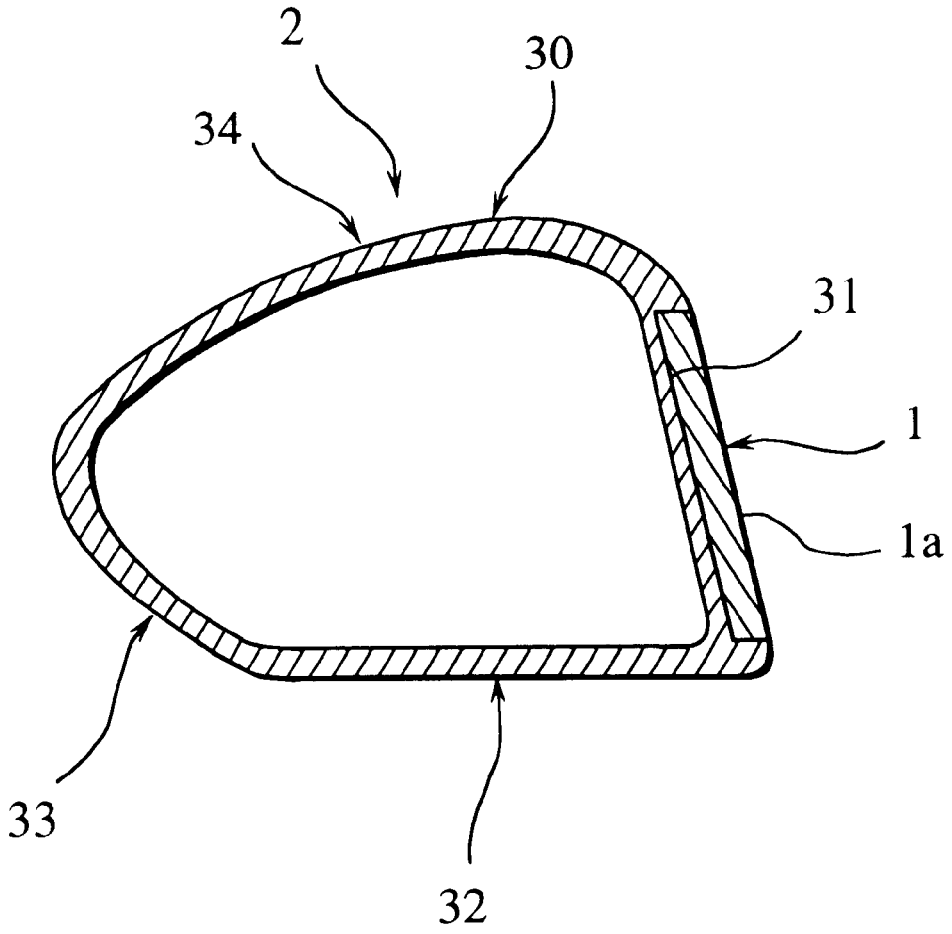
FIG. 8 is a cross-sectional side view showing a wood type golf club head.

FIG. 7 and FIG. 8 show a hollow golf club head 2 of wood type (a metal head) with the above-described face body 1 made of amorphous metal. Specifically, the head 2 is composed of a head main body 30 made of titanium, titanium alloy, stainless steel, etc., and the face body 1 of amorphous metal fitted to a recess portion 31 for fitting formed on the face 1*a* side of the head main body 30. In this case, 32 is a sole, 33 is a side portion, 34 is a crown portion, and 35 is a neck portion. The face body 1 is fitted to the recess portion 31 for fitting of the head main body 30, and fixed with adhesive, welding, caulking, press-fitting, etc. Although bottom face of the concave portion 31 for fitting is entirely continuous in FIG. 8, the bottom face may have an opening (a through hole) in its center portion.

Figure 9:
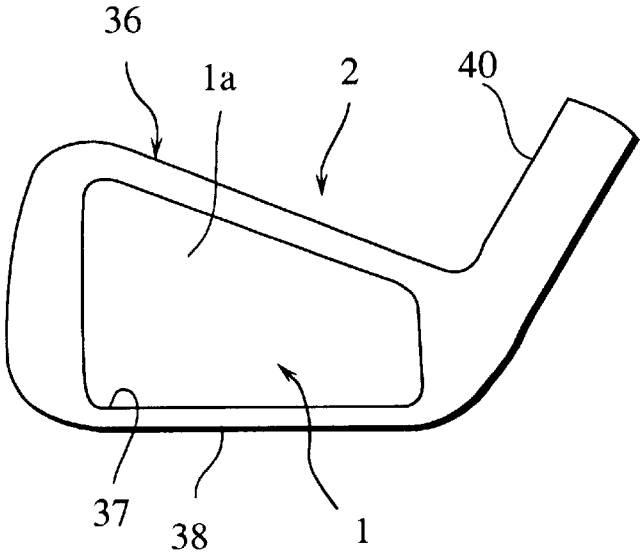
FIG. 9 is a front view showing an iron type golf club head.
Figure 10:
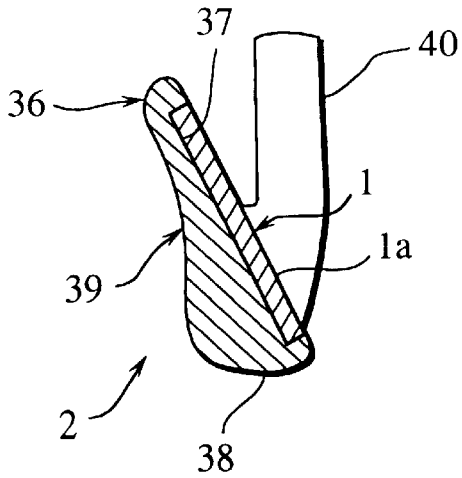
FIG. 10 is a cross-sectional side view showing an iron type golf club head.
Figure 11:
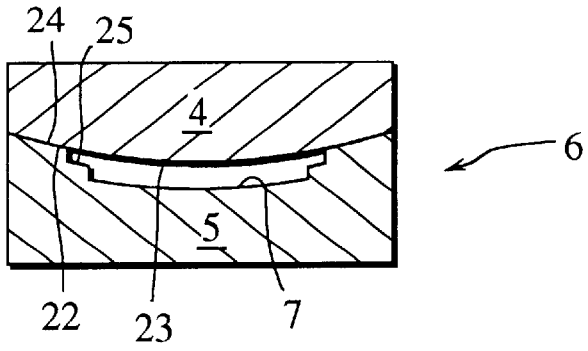
FIG. 11 is a cross-sectional front view showing another configuration of the press metal mold.
Figure 12:
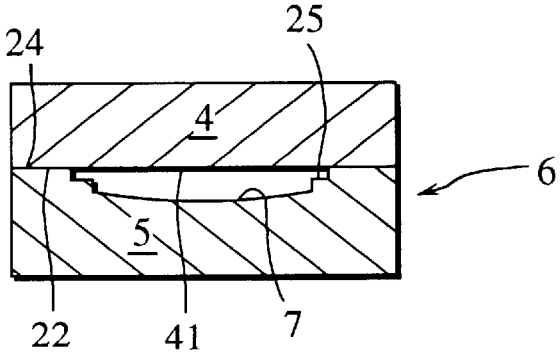
FIG. 12 is a cross-sectional front view showing still another configuration of the press metal mold.

And, FIG. 9 and FIG. 10 show a golf club head 2 of iron type with the above-described face body 1 made of amorphous metal. The head 2 is composed of a head main body 36 made of titanium, titanium alloy, stainless steel, etc., and the face body 1 of amorphous metal fitted to a recess portion 37 for fitting formed on the face la side of the head main body 36. In this case, 38 is a sole, 39 is a back face, and 40 is a neck portion. The face body 1 is (same as described above) fitted to the recess portion 37 for fitting of the head main body 36, and fixed with adhesive, welding, caulking, press-fitting, etc. Although bottom face of the recess portion 37 for fitting is entirely continuous in FIG. 10, the bottom face may have an opening (a through hole) in its center portion.

A golf club provided with the club head 2 having the face body 1 of amorphous metal obtained as described above can keep stable repeatability in ball hittings, and consequently, show excellent flying distance, directionality, impact characteristics, strength, toughness, etc. because the face body of amorphous metal is having unvarying characteristics, excellent strength characteristics, such as high strength and high toughness, having good yield and reduced production cost, and stably manufactured.

Next, another configuration of the above-mentioned press metal mold 6 will be described. The press metal mold 6 shown in FIG. 11 has the parting face 22 and the convex curved face 23 of the upper mold 4 formed as a continuous smooth face, and the parting face 24 of the lower mold 5 formed as a concave curved face. The press metal mold 6 shown in FIG. 12 has the upper mold 4, of which the entire lower face is formed into a continuous plane 41, and the parting face 24 of the lower mold 5 is formed into a plane.

Figure 13:
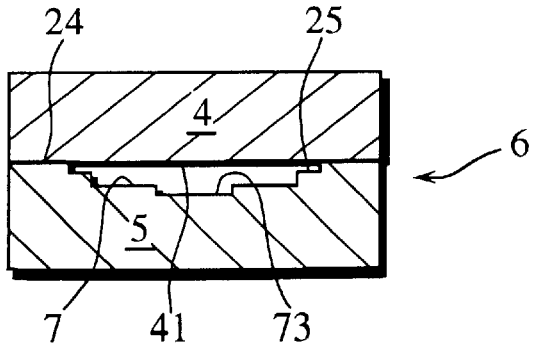
FIG. 13 is a cross-sectional front view showing a further configuration of the press metal mold.

In the press metal mold 6 shown in FIG. 13, the entire lower face of the upper mold 4 is formed into a continuous plane 41, and the parting face 24 of the lower mold 5 has a cavity portion 7 compiled of plane shapes including (having a bottom planar face). In this case, it is preferable to provide a concave portion 73 on a part of the cavity portion 7 of the lower mold 5 to prevent the molten metal from flowing (extending) before being pressed by the upper mold 4 and the lower mold 5.

Figure 14A:
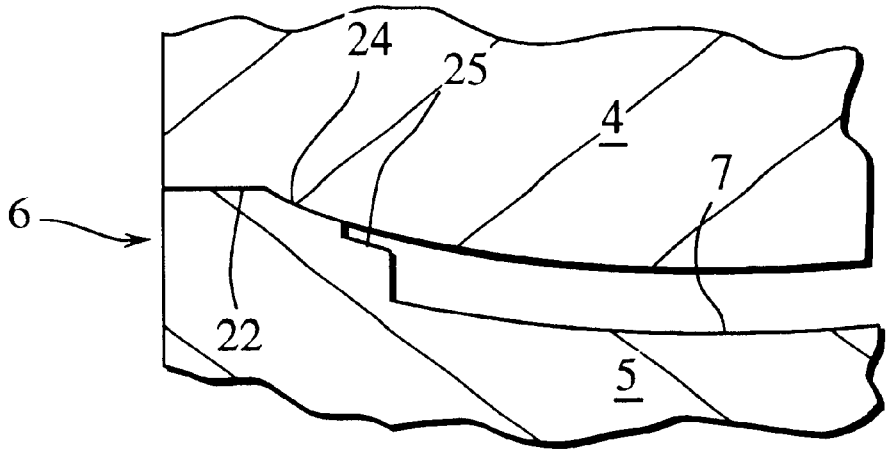
FIG. 14A is a cross-sectional view of an enlarged principal portion of the metal mold showing a configuration of a gap.
Figure 14B:
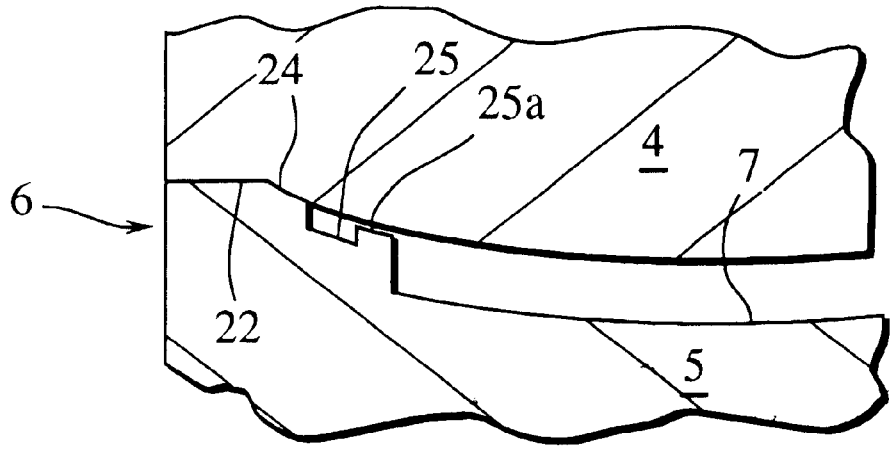
FIG. 14B is a cross-sectional view of an enlarged principal portion of the metal mold showing another configuration of a gap.

And, the configuration of the gap 25 formed on the press metal mold 6 may have a groove-shape as shown in FIG. 14B, instead of the above-described configuration shown in FIG. 14A. An aperture 25*a* may be provided so as to connect the gap 25 with the cavity portion 7 in a closed state of the press metal mold 6.

Figure 15:
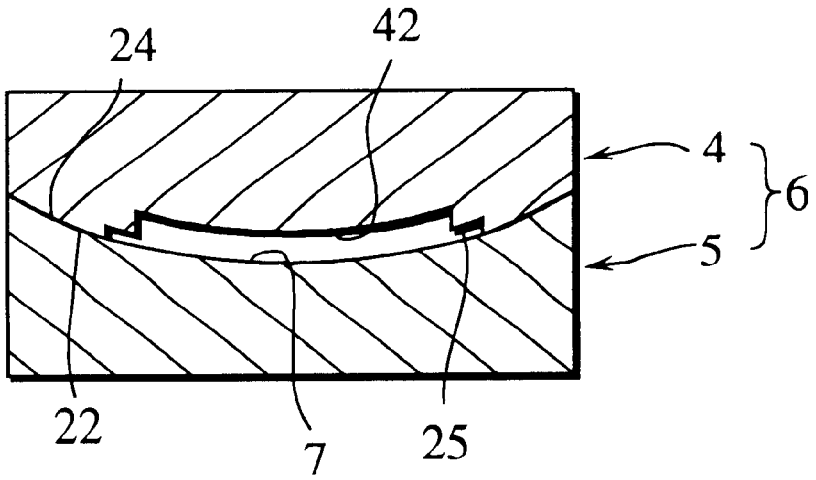
FIG. 15 is a cross-sectional front view showing a press metal mold having a gap on an upper mold.

As shown in FIG. 15, the gap 25 may be arranged on the upper mold 4. In practice, the cavity portion 7 and the parting face 24 of the lower mold 5 are formed into a continuous concave curved face (a smooth face). A concave portion 42 opening below is formed on the lower face of the upper mold 4, and the gap 25 is arranged along the parting face 22 of the upper mold 4 formed into a convex curved face.

Figure 16:
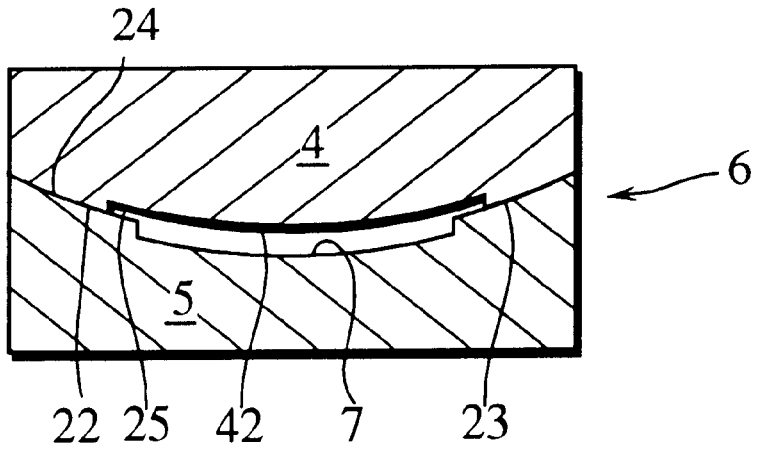
FIG. 16 is a cross-sectional front view showing another configuration of the press metal mold having a gap on an upper mold.

The press metal mold 6 may be formed into a configuration as shown in FIG. 16. That is to say, in the press metal mold 6, the lower mold 5 has the cavity portion 7 including a concave curved face, of which the radius of curvature is more than 5 inches. The upper mold 4 has a convex curved face 23, of which the radius of curvature is more than 5 inches. A concave portion 42 opening below, of which the width dimension is larger than that of the cavity portion 7, is formed on the convex curved face 23 of the upper mold 4. The concave portion 42 has a radius of curvature of more than 5 inches. And, the gap 25 is formed between the parting face 24 of the lower mold 5 and the peripheral rim of the concave portion 42 of the upper mold 4.

Figure 17:
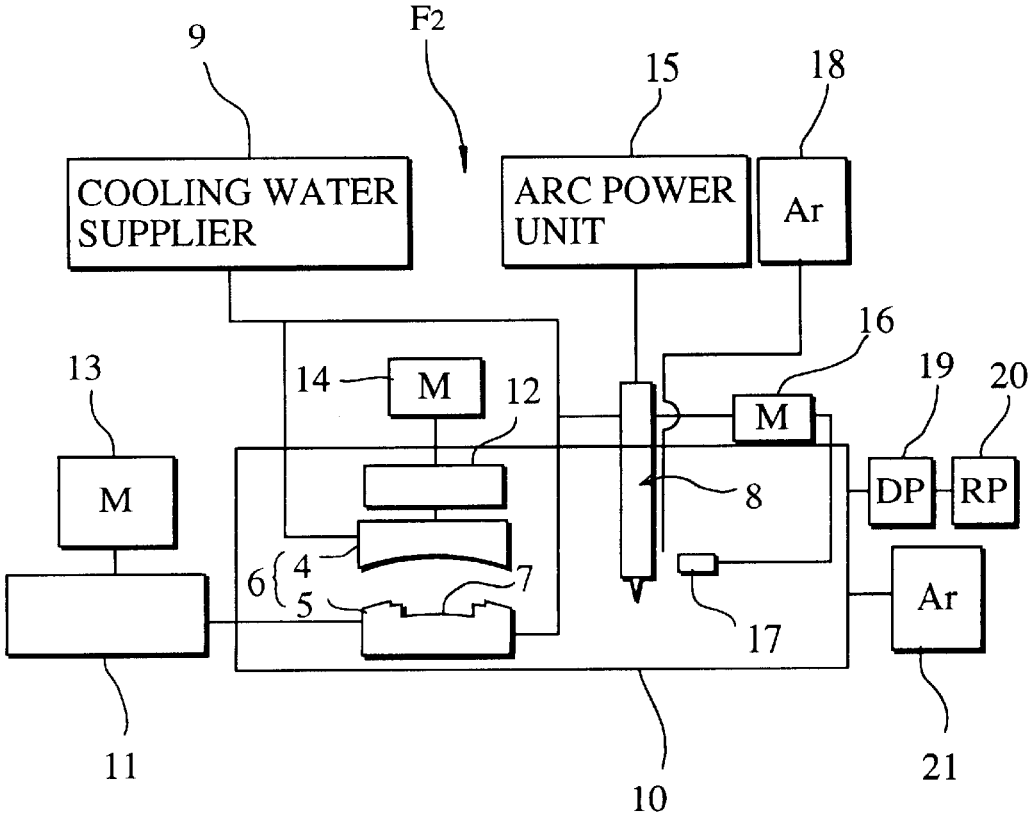
FIG. 17 is an explanatory view of a construction of another manufacturing apparatus which produces the molded product of amorphous metal of the present invention.
Figure 18:
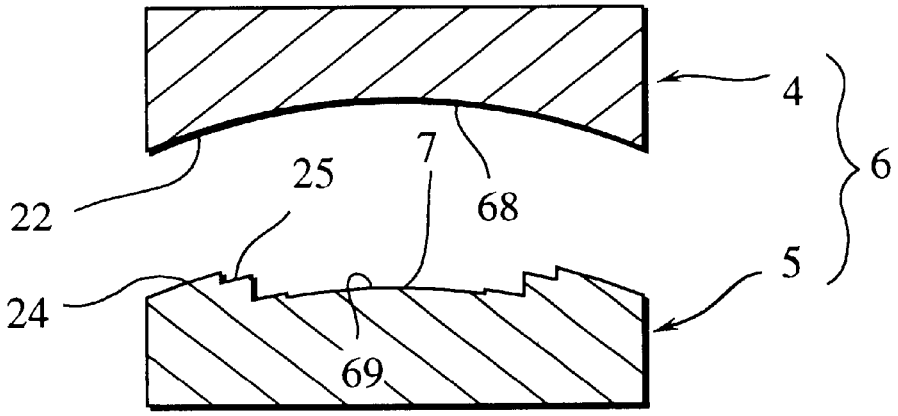
FIG. 18 is a cross-sectional front view showing a press metal mold.
Figure 19:
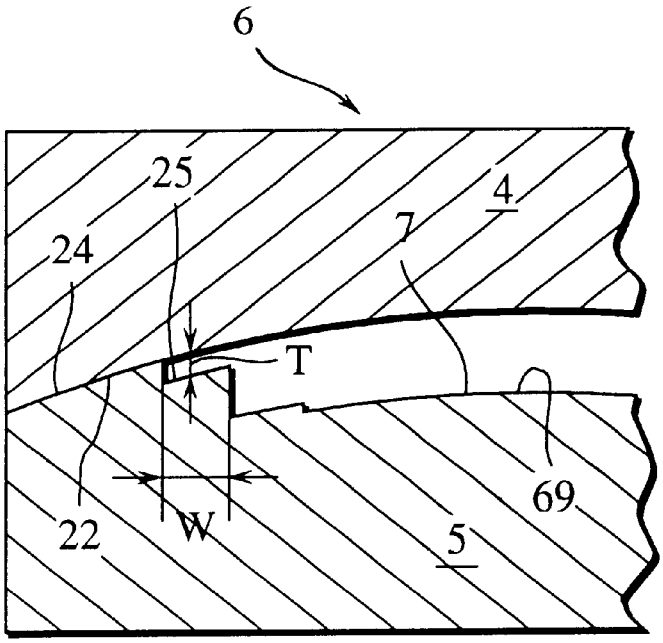
FIG. 19 is a cross-sectional view showing an enlarged principal portion of a press metal mold.

Next, FIG. 17 shows another manufacturing apparatus $F_2$ which produces a molded product of amorphous metal. That is to say, this manufacturing apparatus $F_2$, as shown in FIG. 17 through FIG. 19, has a press metal mold 6 of a configuration without engagement portions. An upper mold 4 has a smooth concave curved face 68 of which the radius of curvature is 5 inches to 100 inches, and a part of the concave curved face 68 is a parting face 22. A lower mold 5 has a convex-curved cavity portion 7 having a radius of curvature of over 5 inches, and a convex-curved parting face 24 which contacts the parting face 22 of the upper mold 4. A shallow concave portion 69 is formed at the center of a bottom face of the cavity portion 7 to prevent molten metal from flowing.

As shown in FIG. 19, a gap 25, of which gap dimension T is 0.1 mm to 3.0 mm and width dimension W is 4.0 mm to 20.0 mm (in a closed state of the metal mold 6), is formed along the parting face 24 of the lower mold 5, and excessive molten metal flows into the gap 25 during molding. The configuration of the press metal mold 6, which is not restricted to the configuration described above, may have configurations as shown in FIG. 23 through FIG. 26 which will be described later in detail. In the manufacturing apparatus $F_2$, construction of the apparatus is similar to the construction formerly described with reference to FIG. 1 except for the press metal mold 6.

Next, a manufacturing method for the molded product of amorphous metal of the present invention practiced by the manufacturing apparatus $F_2$ will be described.

Figure 20A:
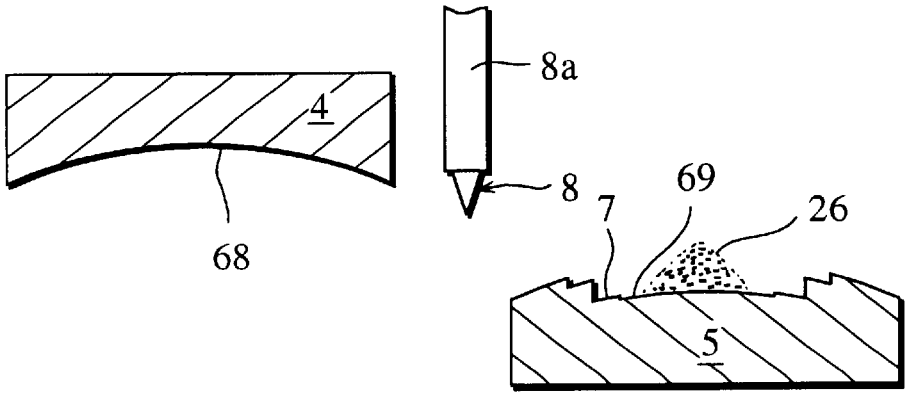
FIG. 20A is a first explanatory view showing a production process of the molded product of amorphous metal with the manufacturing apparatus.
Figure 20B:
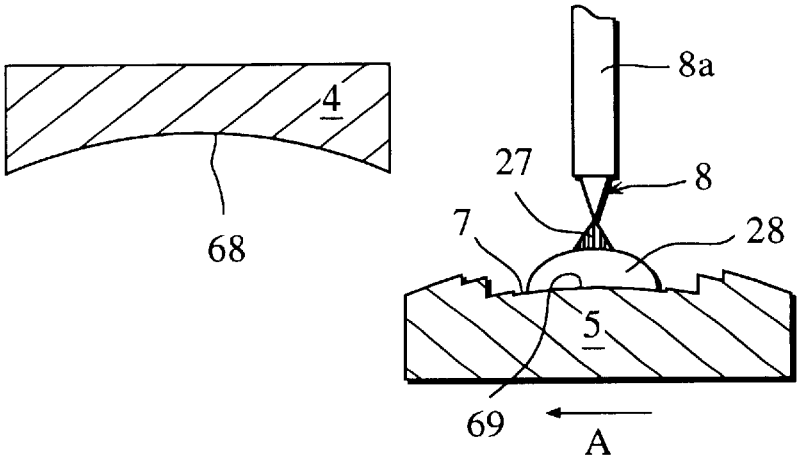
FIG. 20B is a second explanatory view showing the production process of the molded product of amorphous metal with the manufacturing apparatus.

First, as shown in FIG. 17 and FIG. 20A, a metal material 26 is placed on the concave portion 69 of the cavity portion 7 of the lower mold 5. After the preparation, as shown in FIG. 17 and FIGS. 20A and 20B, the lower mold 5 is moved in a horizontal direction (a direction as shown by arrow A) by a lower mold moving mechanism 11 driven by a motor 13, and stopped below an arc electrode 8. An arc power unit 15 is switched on. Plasma arc 27 is generated from a tip end of the arc electrode 8 to the metal material 26, and molten metal 28 is formed by fusing the metal material 26 completely. The molten metal 28 is prevented from flowing by the concave portion 69 of the cavity portion 7, and receives the plasma arc 27 effectively.

Figure 20C:
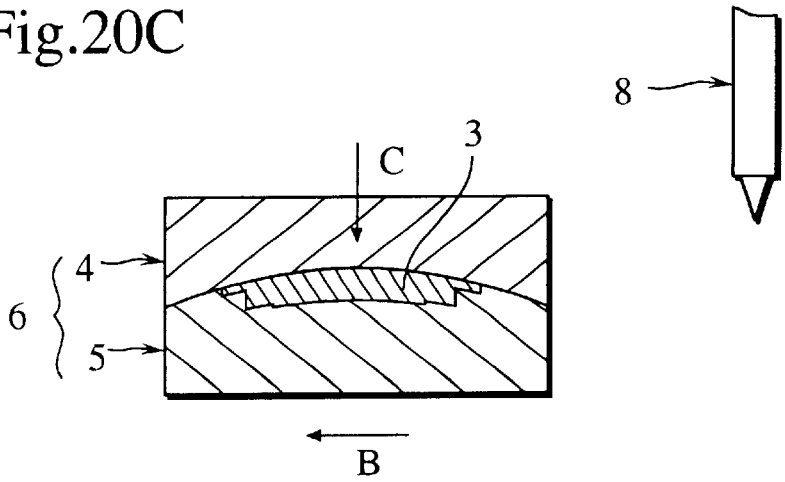
FIG. 20C is a third explanatory view showing the production process of the molded product of amorphous metal with the manufacturing apparatus.

Then, as shown in FIG. 17 and FIGS. 20B and 20C, the arc power unit is switched off, and the plasma arc 27 is terminated. The lower mold 5 is then quickly moved in a direction shown by arrow B to a position below the upper mold 4. The upper mold 4 is moved down in a direction shown by arrow C by a motor 14 and an upper mold moving mechanism, and the obtained molten metal 28 is pressed between the upper mold 4 and the lower mold 5 and transformed into a predetermined configuration. The molten metal 28 has good molding stability since the molten metal 28 is concentrated at the central part of the cavity portion 7. The molten metal 28 is cooled at over a critical cooling rate by the cooled press metal mold 6 at the same time or after the transformation, and the molten metal 28 is rapidly solidified and a molded product 3 of the predetermined configuration is made thereby.

Figure 21:
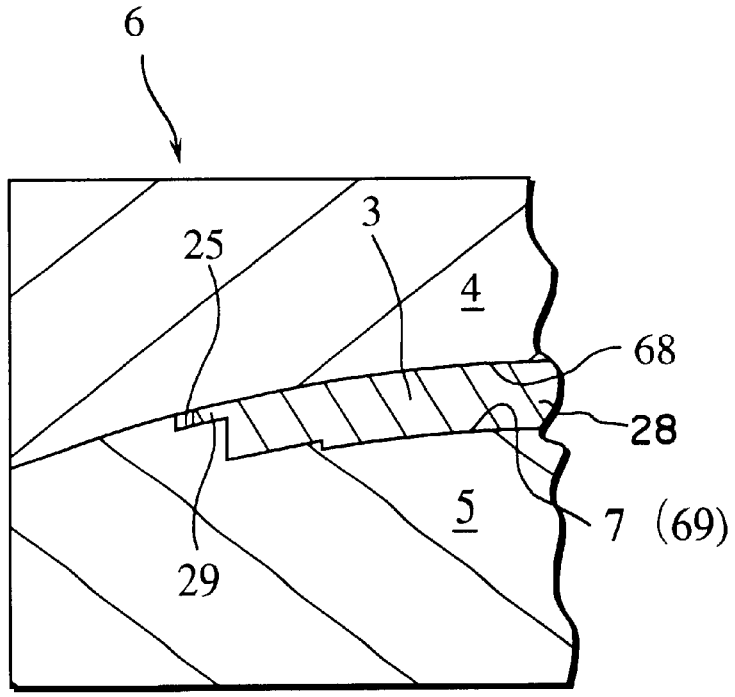
FIG. 21 is a cross-sectional view showing an enlarged principal portion of a closed state of the press metal mold.

As shown in FIG. 21, in molding the molded product 3, excessive molten metal flows into the previously described gap 25 formed in the lower mold 5 and becomes flash 29 of the molded product 3 upon cooling solidification. That is to say, the molded product 3 of the predetermined thickness is certainly obtained without interruption of the closing of the press metal mold 6. And, the press metal mold is not damaged by the flash 29, and the press metal mold 6 has high durability.

The molded product 3 of thin plate shape made by the method described above is a molded product of amorphous metal (amorphous alloy) that is cooled and solidified uniformly, not mixed with crystal phase caused by ununiform solidification and ununiform nucleation, and is excellent in strength characteristics, such as high strength and high toughness without defects, such as cold shut, because the molten metal is transformed into a predetermined configuration and cooled simultaneously. That is to say, after the fusing of the metal material, the obtained molten metal can be pressed and transformed without having contacts with cooling surfaces of the molten metal under the melting point.

Figure 22A:
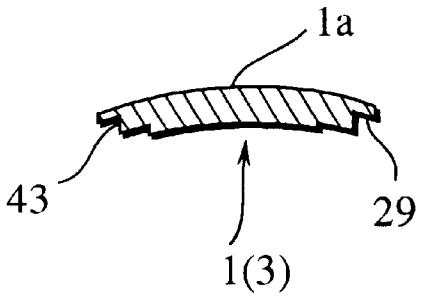
FIG. 22A is a cross-sectional view showing a state before finishing of the molded product of amorphous metal of the present invention.

FIG. 22A shows the above-described molded product 3 taken out of the press metal mold 6. The molded product 3 is, in this preferred embodiment, a face body (face plate) 1 of a golf club head. The face body 1 initially has the flash 29 on a peripheral edge 43; however, the flash 29 is cut, and the face body 1 is finished as a product as shown in FIG. 22B, wherein 1*a* represents a face of convex curve.

Figure 22B:
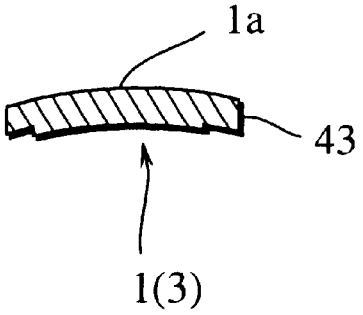
FIG. 22B is a cross-sectional view showing a production state of the molded product of amorphous metal of the present invention.
Figure 23:
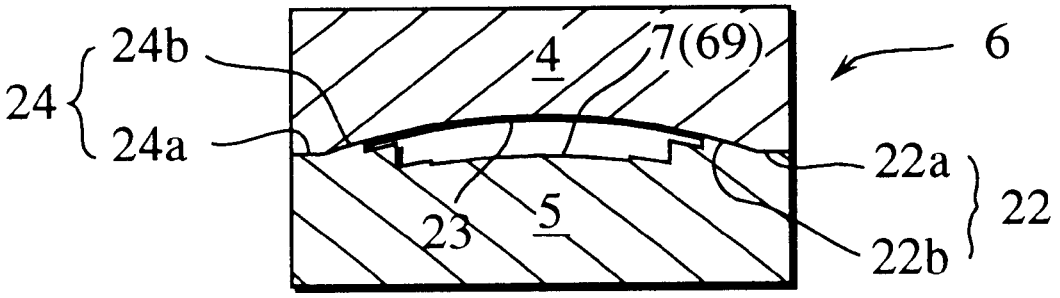
FIG. 23 is a cross-sectional front view showing another configuration of the press metal mold.
Figure 24:
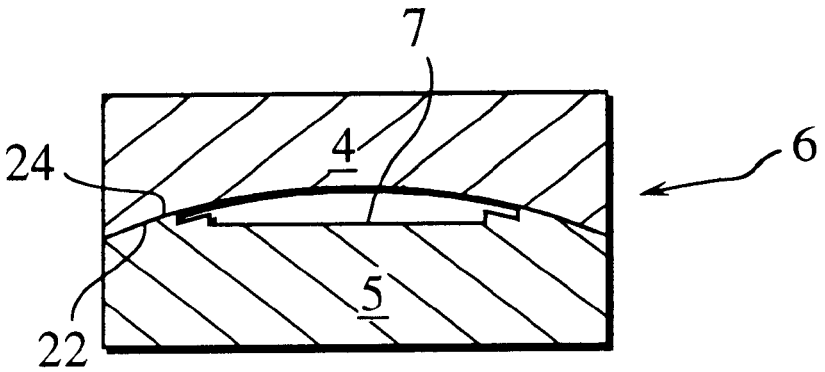
FIG. 24 is a cross-sectional front view showing still another configuration of the press metal mold.

Therefore, as shown in FIG. 21 and FIGS. 22A and 22B, the face body 1 can demonstrate sufficient functions as a face of a golf club head in which high strength is required for ball hitting, because the face 1*a* of the face body 1, which directly hits a golf ball, is transformed by the upper mold 4 having the concave curved face 68 in the molding. That is to say, the molten metal 28 fused in the cavity portion 7 of the lower mold 5 can retain higher temperature at an upper portion than at a lower portion touching the cooled lower mold 5 until the upper mold 4 comes down and presses the molten metal. And, the upper portion of the molten metal 28 touching the upper mold 4 is more rapidly cooled than the lower portion of the molten metal when pressed by the upper mold 4, and a face body of amorphous metal, of which face side 1*a* is further-strengthened, can be obtained thereby.

A case in which a part of the molten metal 28 remains in the crystal phase without forming the amorphous phase after press molding is contemplated. Because the lower mold 5 is fairly heated during the fusing of the metal material 26, and the part of the molten metal 28 touching the lower mold 5 has a lower cooling rate in comparison with a part cooled by the upper mold 4. And the crystal phase may retain a border line with surrounding amorphous phase in external appearance, and may be non-uniform in strength with the amorphous phase. It is preferable that the crystal phase area not be on a side which directly hits a ball (the face e.q., side 1*a*) for external appearance and durability of the golf club head. In the manufacturing method for a molded product of amorphous metal of the present invention, this problem is solved by the arrangement that the crystal phase is disposed on the opposite side of the face 1*a* (i.e., the reverse side of the face body 1 of amorphous metal).

As described with reference to FIG. 18 and FIG. 19, a space in which the molten metal is sufficiently absorbed is prepared and cutting work of the flash 29 becomes easy for the arrangement that the gap dimension T of the gap 25 is 0.1 mm to 3.0 mm and the width dimension W is 4.0 mm to 20.0 mm. If the gap dimension T is less than 0.1 mm, the molten metal hardly flows into the gap 25, and if the gap dimension T is over 3.0 mm, the flash 29 becomes thick and difficult to cut. On the other hand, if the width dimension W is less than 4.0 mm, the molten metal is not absorbed sufficiently, and if the width dimension is over 20.0 mm, the metal mold 6 becomes large. The face body 1, after molding, does not need working for bulge adjustment, since the radius of curvature of the lower mold 5 forming the face 1*a* is arranged to be 5 inches to 100 inches, and the radius of curvature of the upper mold 4 is arranged to be more than 5 inches. If the radius of curvature of the lower mold 5 is less than 5 inches, after-working, such as cutting and polishing for diminishing the bulge of the face body 1 becomes necessary, and if the radius of curvature of the lower mold 5 is more than 100 inches, after-working for adding the bulge becomes necessary.

The face body 1 of amorphous metal of the present invention made as described above, which have unvarying characteristics, excellent strength characteristics, such as high strength and high toughness, good yield and reduced production cost, and being stably manufactured, is used as a face for a hollow golf club head 2 of the wood type and a golf club head 2 of iron type, so that stable repeatability in ball hittings is kept thereby, and consequently, excellent characteristics, such as long flying distance, directionality, impact characteristics, strength, toughness, etc. are demonstrated.

Next, other configurations of the above-described press metal mold 6 will be described. The press metal mold 6 shown in FIG. 23 has a parting face 22 composed of a plane 22*a* and a concave curved face 22*b* on the upper mold 4, and a parting face 24 composed of a plane 24*a* and a convex curved face 24*b* on the lower mold 5. The press metal mold 6 shown in FIG. 24 has a plane-shaped cavity portion 7 on the lower mold 5, and the shallow concave portion 69 (refer to FIG. 21) is omitted. The concave portion 69 may be formed on the plane of the cavity portion 7.

Figure 25A:
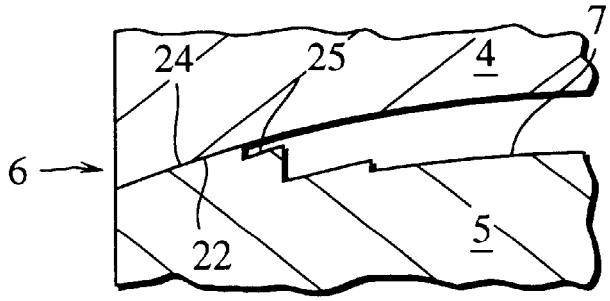
FIG. 25A is a cross-sectional view of an enlarged principal portion of the metal mold showing a configuration of a gap.
Figure 25B:
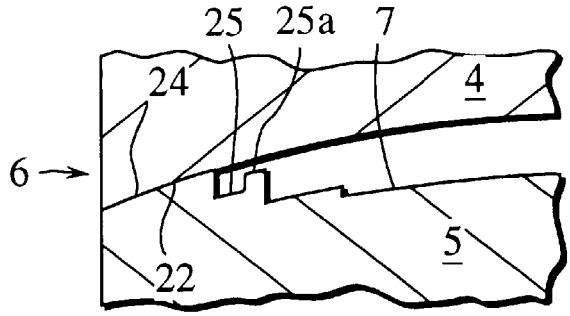
FIG. 25B is a cross-sectional view of an enlarged principal portion of the metal mold showing another configuration of a gap.

The configuration of the gap 25 formed on the press metal mold 6 may be a groove-shape as shown in FIG. 25B, instead of the (above-described) configuration shown in FIG. 25A. An aperture 25*a* may be provided as to connect the gap 25 with the cavity portion 7 in a closed state of the press metal mold 6.

Figure 26:
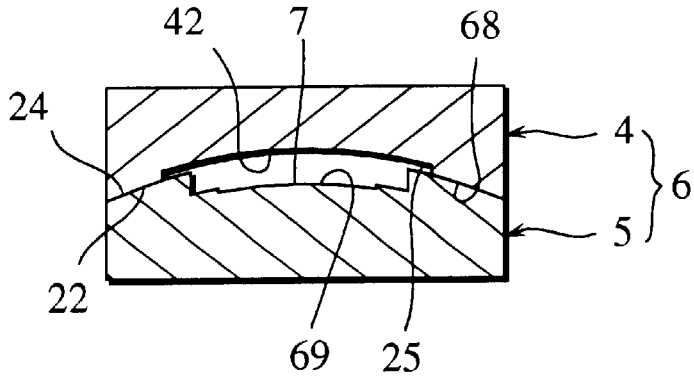
FIG. 26 is a cross-sectional front view showing a press metal mold having a gap on an upper mold.

As shown in FIG. 26, the gap 25 may be arranged on the upper mold 4. As shown, a concave portion 42 curved and opening below having a width dimension larger than width dimension of the cavity portion 7 is formed on a concave portion 68 of the upper face 4, and a peripheral part of the concave portion 42 which outstretches the cavity portion 7 is the gap 25.

Figure 27:
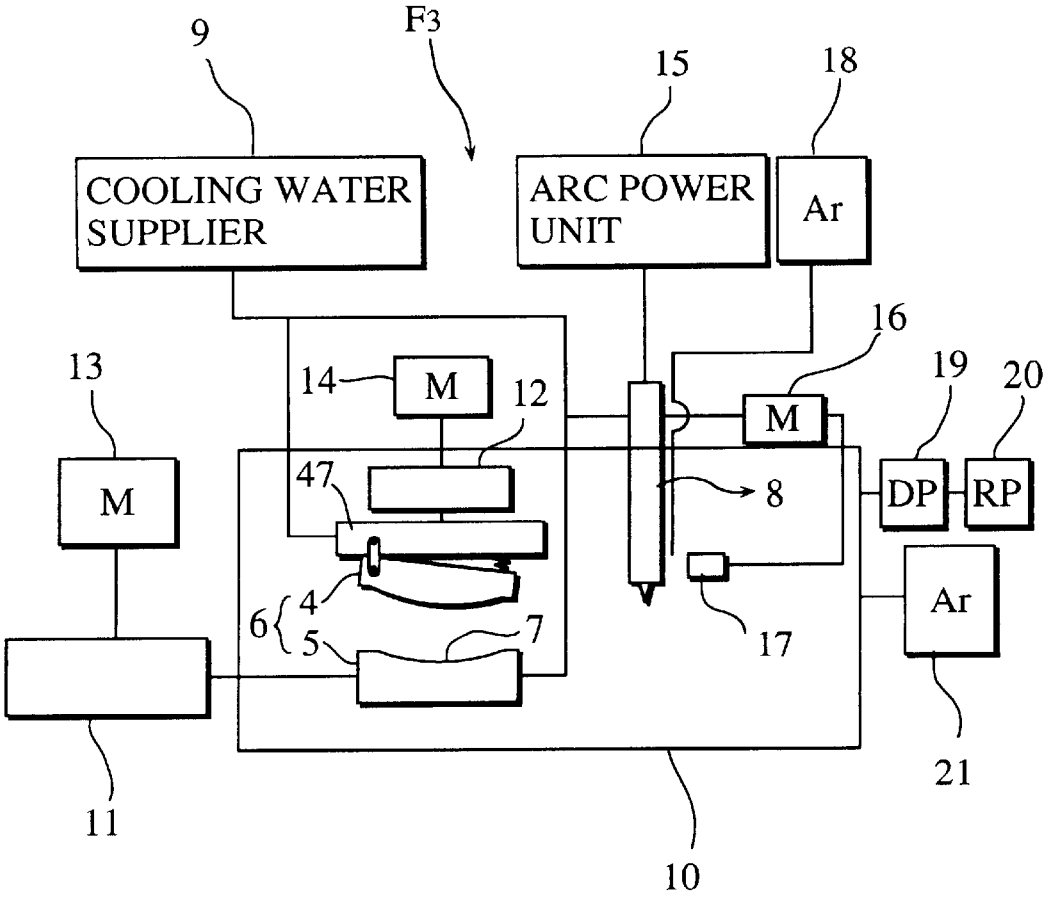
FIG. 27 is an explanatory view of a construction of still another manufacturing apparatus which produces the molded product of amorphous metal of the present invention.
Figure 28:
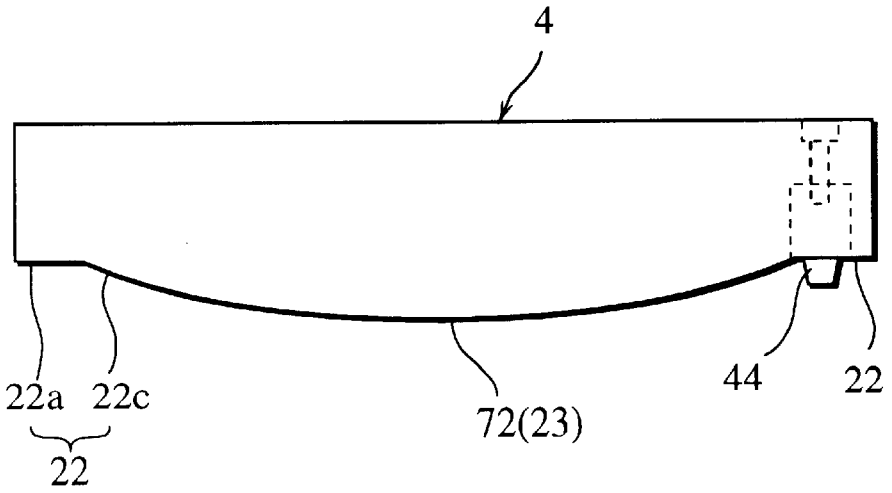
FIG. 28 is a front view showing an upper mold of the press metal mold.
Figure 29:
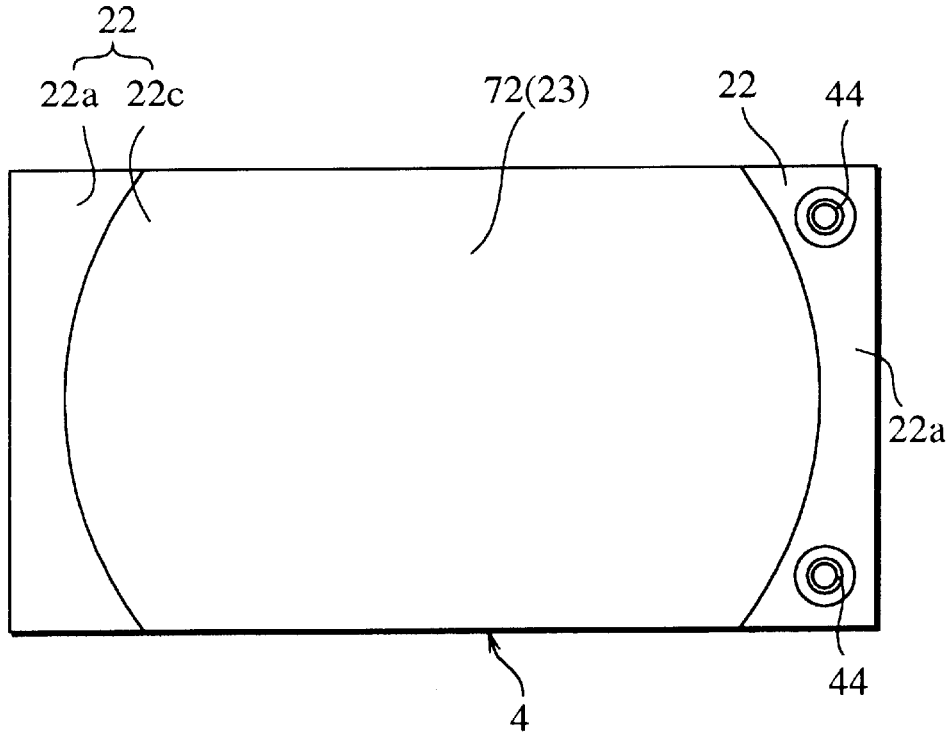
FIG. 29 is a bottom view showing an upper mold of the press metal mold.
Figure 30:
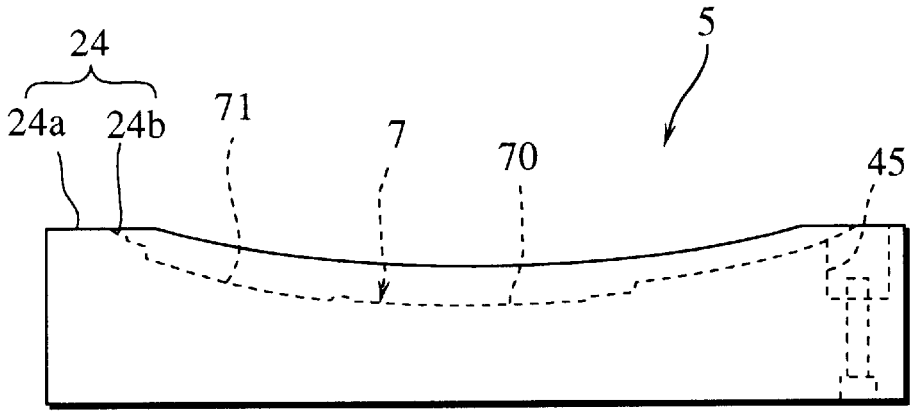
FIG. 30 is a front view showing a lower mold of the press metal mold.
Figure 31:
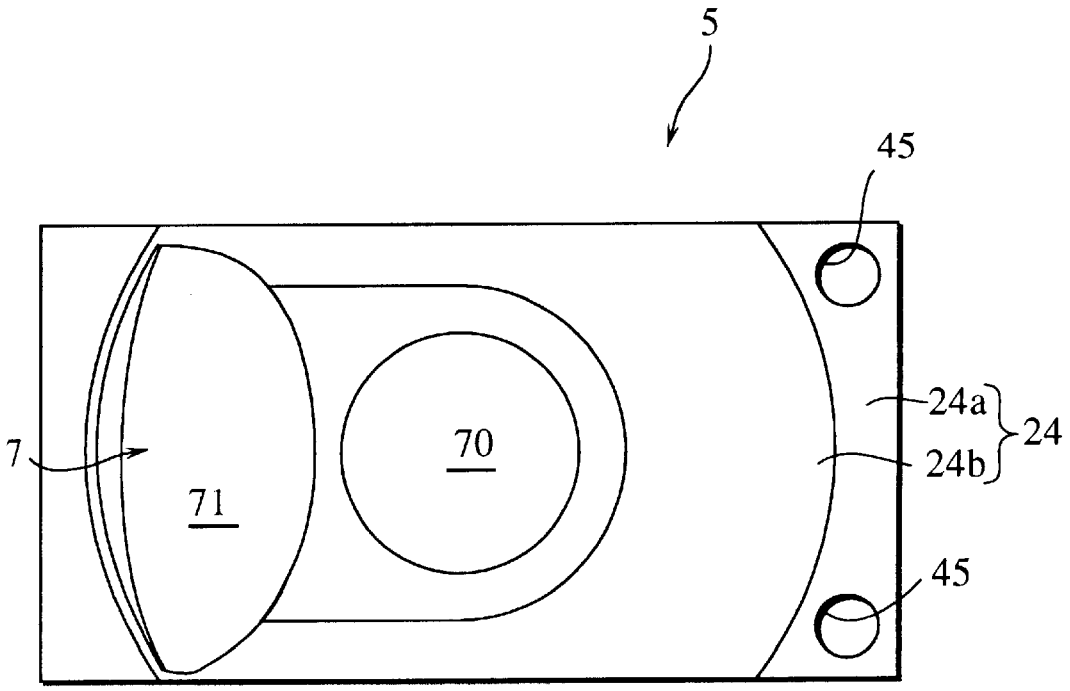
FIG. 31 is a top view showing a lower mold of the press metal mold.

Next, FIG. 27 shows still another manufacturing apparatus $F_3$ which produces a molded product of amorphous metal of the present invention. That is to say, this manufacturing apparatus $F_3$, as shown in FIG. 27 through FIG. 31, has a press metal mold 6 of a configuration without engagement portions. An upper mold 4 has a smooth curved face 72 of which the radius of curvature is over 5 inches. In this preferred embodiment, the curved face 72 is a convex curved face 23, and a parting face 22 is composed of a convex curved face portion 22*c* which is a part of the convex curved face 23 and a plane portion 22*a*. And, a pair of tapered knock pins 44 are attached to the plane portion 22*a* of the parting face 22 on one side of the upper mold 4 (right end side in the figures) as to protrude below. Further, a part forming the curved face 72 may be a smooth concave curved face of which the radius of curvature is more than 5 inches, or a plane (not shown in the figures). And, a part forming the convex curved face portion 22*c* may be a concave curved face or a plane (not shown in the figures).

A lower mold 5 has a parting face 24 composed of a plane 24*a* and a concave curved face 24*b* which contacts the parting face 22 of the upper mold 4, and a cavity portion 7 having a first concave portion 70 and a second concave portion 71. Two bushings 45 for positioning the above-mentioned tapered knock pins 44 when the metal mold is closed are arranged on the plane 24*a* of the parting face 24 of the lower mold 5 (right end side in the figures). The shallow first concave portion 70, on which metal material is placed and molten metal is prevented from flowing out, is for placing and fusing of materials, and is circular in top view, and disposed in the middle of the lower mold 5. The second concave portion 71 is for final molding where the molten metal raised from the first concave portion 70 flows into, and a molded product of amorphous metal is formed into a predetermined configuration. The second concave portion 71 is formed into a concave curved face of which the radius of curvature is 5 inches to 100 inches, and the configuration is, in this preferred embodiment, a face of a golf club head (final configuration) in a top view. A part forming the concave curved face 24*b* may be a smooth concave curved face of which the radius of curvature is over 5 inches, or a plane (not shown in the figures).

Further, the first concave portion 70 is disposed at a lower position in the center of the lower mold 5, and the second concave portion 71 is disposed at a position next to the first concave portion 70 and opposite to the bushings 45.

Figure 32:
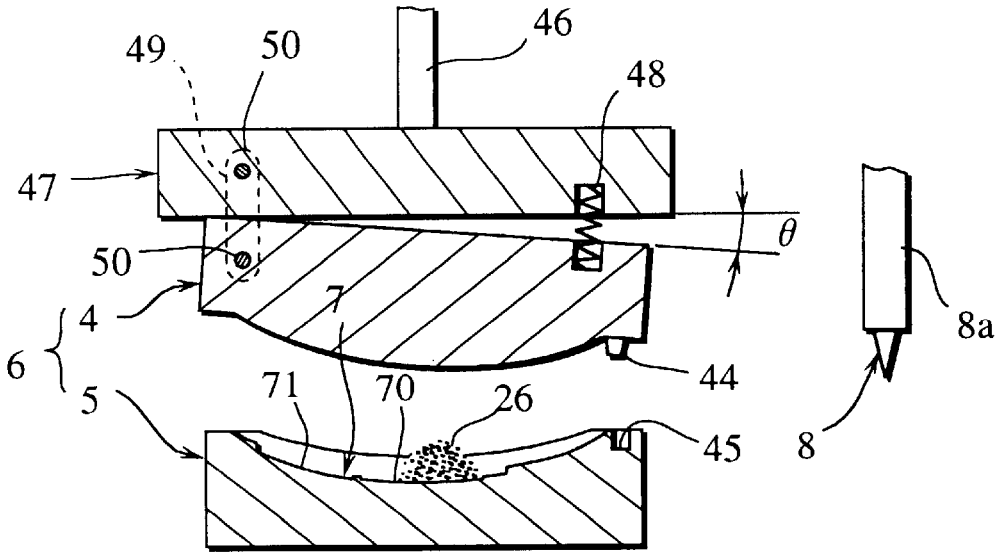
FIG. 32 is a cross-sectional front view showing a first oscillation press mechanism which holds the upper mold with an inclination.

As shown in FIG. 27 and FIG. 32, numeral 46 represents an elevation rod of an upper mold moving mechanism 12, and an attachment member 47 for holding the upper mold 4 of the press metal mold 6 is fixed to a lower end of the elevation rod 46 horizontally. And, the upper mold 4 is attached to a lower face side of the horizontal attachment member 47 with an inclination. As shown, the right side (i.e., the side having the tapered knock pin 44) of the upper mold 4 is connected with the right side of the attachment portion 47 through an elastic member 48 (a coil spring, for example), the left side of the upper mold 4 is connected with left side of the attachment member 47 through two reciprocating pieces 49 (only one of them is shown in the figures) and supporting shafts 50, and the upper mold 4 is inclined by the tapered knock pin 44 side being elastically pushed below by the elastic member 48. At the same time, the lower mold 5 is positioned horizontally parallel to the attachment member 47, and the relative inclination angle θ between the upper mold 4 and the lower mold 5, namely, inclination angle θ of the upper mold 4 to the lower mold 5 (the attachment member 47) is arranged to be from 1° to 15°. In the manufacturing apparatus $F_3$, construction of the apparatus is similar to the construction previously described with reference to FIG. 1 (manufacturing apparatus $F_1$) and FIG. 17 (manufacturing apparatus $F_2$), except for the press metal mold 6 and its attachment portion.

Next, a manufacturing method for the molded product of amorphous metal of the present invention with the manufacturing apparatus $F_3$ will be described.

Figure 33:
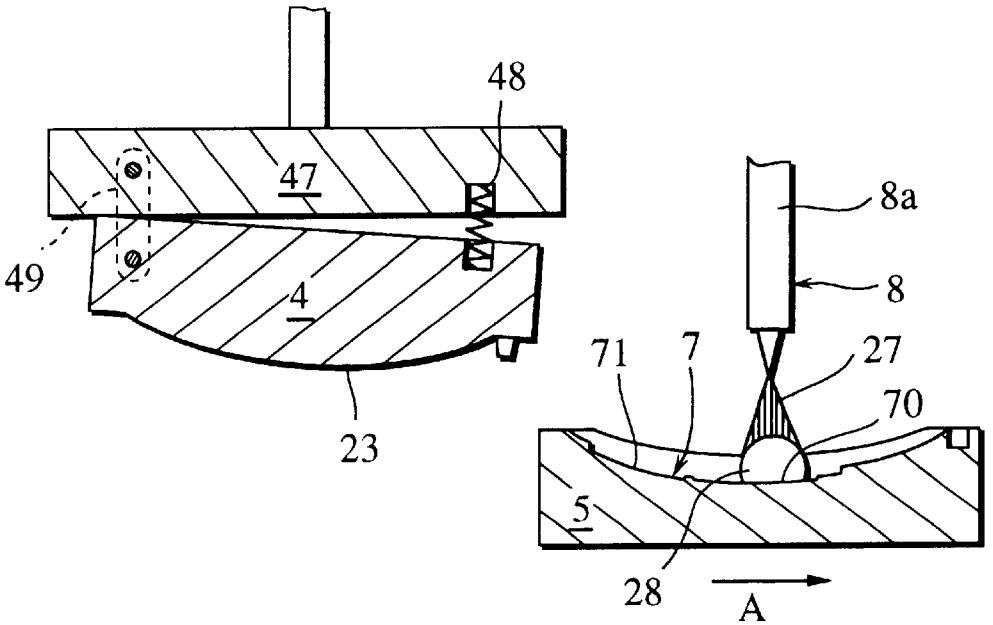
FIG. 33 is an explanatory view showing a formed state of a molten metal.

First, as shown in FIG. 27 and FIG. 32, a metal material 26 is placed on the first concave portion 70 of the cavity portion 7 of the lower mold 5 set below the upper mold 4. And, as shown in FIG. 27, FIG. 32, and FIG. 33, the lower mold 5 is moved in a horizontal direction (a direction shown by an arrow A) by a lower mold moving mechanism 11 driven by a motor 13, and stopped below an arc electrode 8. An arc power unit 15 is switched on, plasma arc 27 is generated from a tip end of the arc electrode 8 to the metal material 26, and molten metal 28 is formed by fusing the metal material 26 completely. The molten metal 28 is prevented from flowing by the first concave portion 70 of the cavity portion 7, and receives the plasma arc 27 effectively.

Then, as shown in FIG. 27 and FIGS. 32 through 35, the arc power unit is switched off, and the plasma arc 27 is terminated. The lower mold 5 is quickly moved (in a direction shown by arrow B) to a position below the upper mold 4. The upper mold 4 is then moved down (in a direction shown by arrow C) by a motor 14 and an upper mold moving mechanism 12, and the obtained molten metal 28 having a temperature above the melting point is pressed and transformed into a predetermined configuration. The molten metal 28 is cooled at over a critical cooling rate by the cooled press metal mold 6 simultaneously with, or after, the transformation, and the molten metal 28 is rapidly solidified whereby a molded product 3 of the predetermined configuration is made thereby. The molded product 3 of the predetermined configuration is a partially fabricated product having flash.

Figure 34:
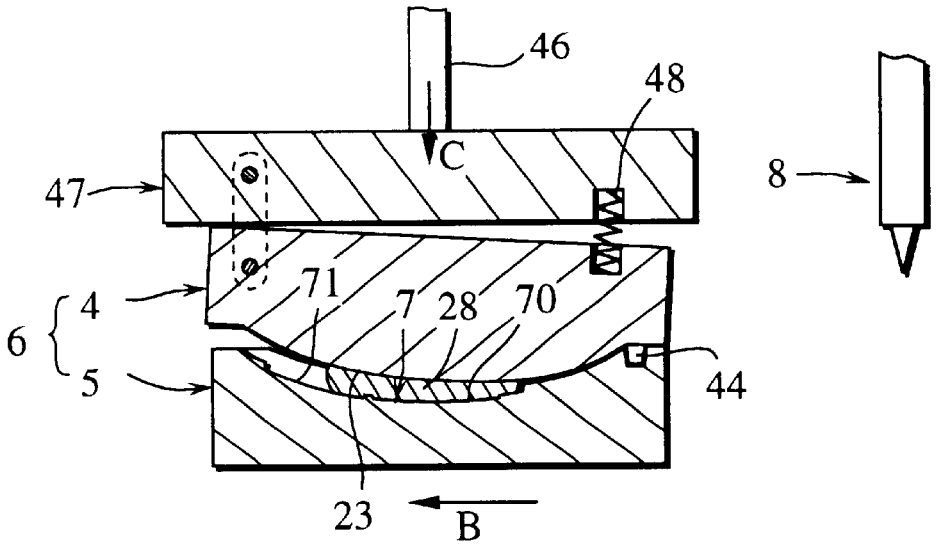
FIG. 34 is an explanatory view showing a pressed state of the molten metal with the press metal mold.
Figure 35:
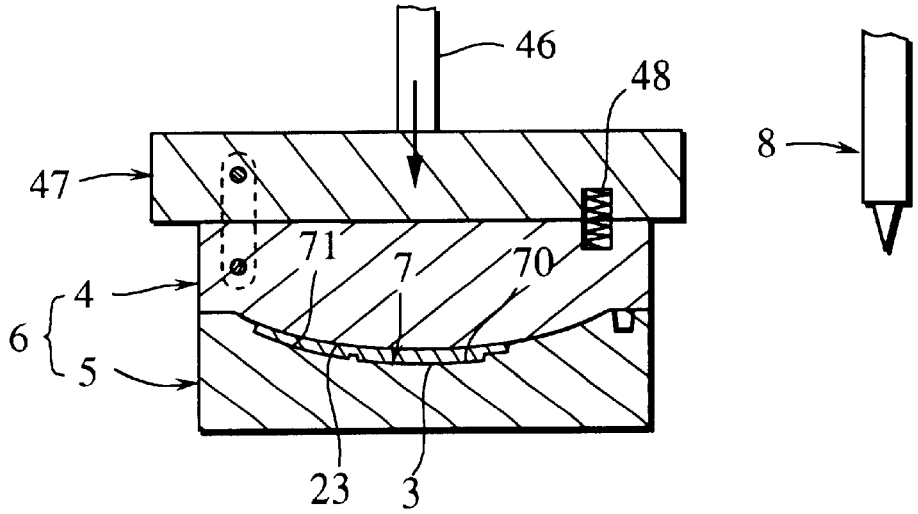
FIG. 35 is an explanatory view showing a closed state of the press metal mold.
Figure 36A:
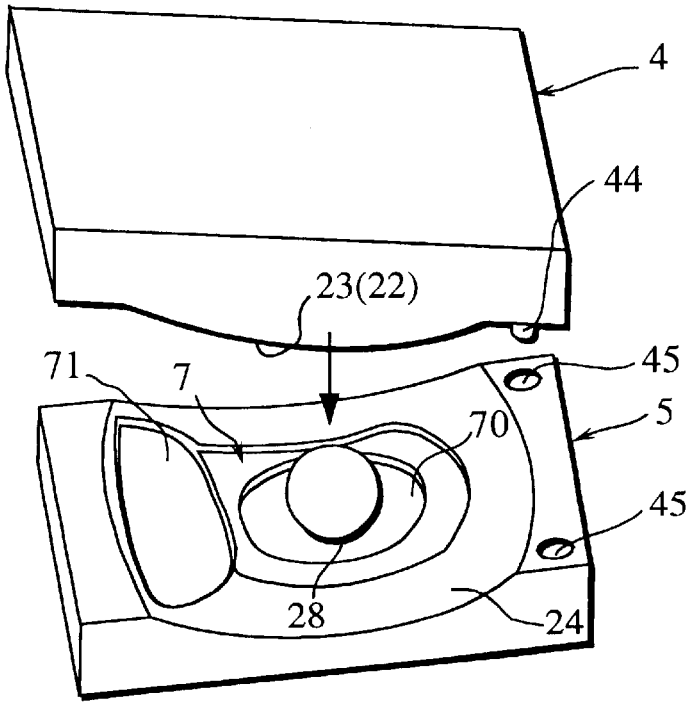
FIG. 36A is a first work-explanatory view of the press molding.
Figure 36B:
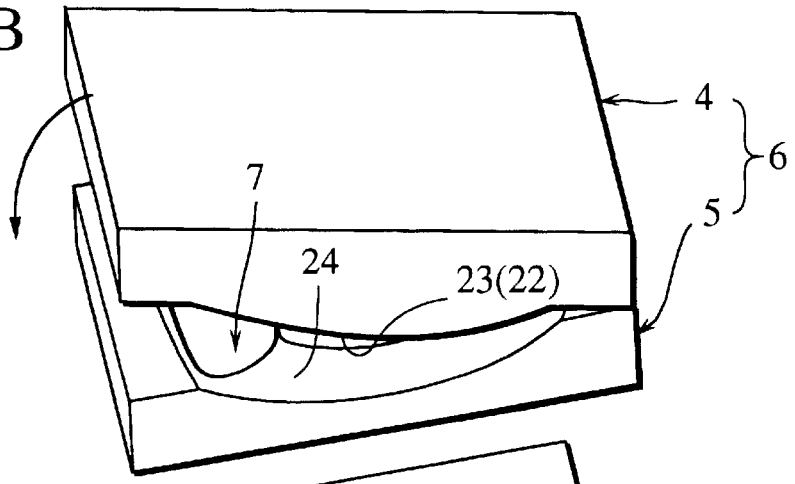
FIG. 36B is a second work-explanatory view of the press molding.
Figure 36C:
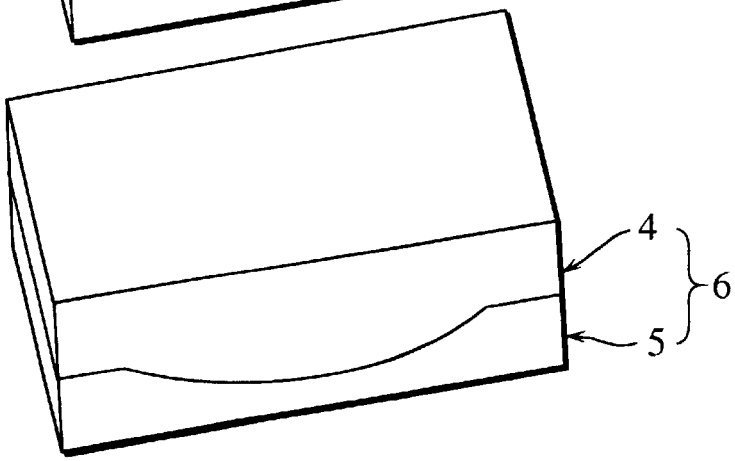
FIG. 36C is a third work-explanatory view of the press molding.

Closing of the upper mold 4 and the lower mold 5 will be described here in detail. As shown in FIG. 36A, the inclined upper mold 4 descends to the lower mold 5. As shown in FIG. 34 and FIG. 36B, the descending upper mold 4 is positioned by the tapered knock pins 44 fitting into the bushings 45 of the lower mold 5. Then, the upper mold 4, pushed by the attachment member 47, oscillates from an inclined state to a parallel state to the lower mold 5 and presses the molten metal 28 all at once (as in rolling) as fits to the lower mold 5. Then, the molten metal 28 raised in the first concave portion 70 flows into the second concave portion 71, and the upper mold 4 and the lower mold 5 are entirely fit and closed, as shown in FIG. 35 whereby FIG. 36C, and the molten metal 28 is rapidly cooled by the second concave portion 71 and becomes the molded product 3 of amorphous metal in the final configuration.

Figure 37:
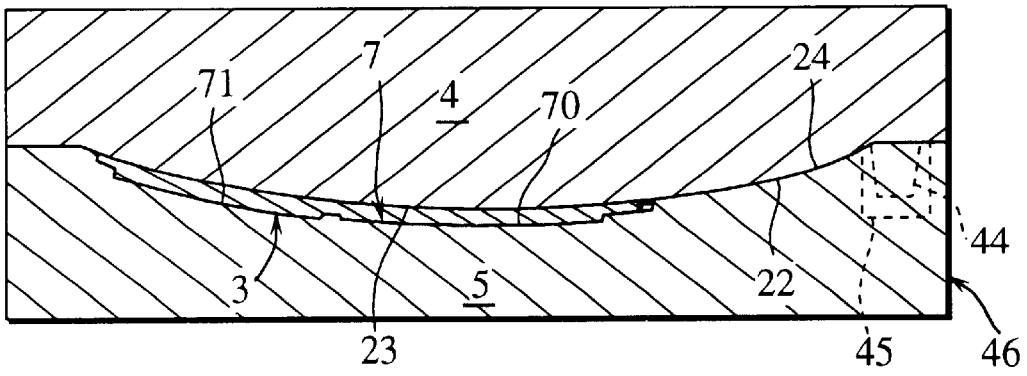
FIG. 37 is a cross-sectional view showing an enlarged principal portion of a closed state of the press metal mold.
Figure 38:
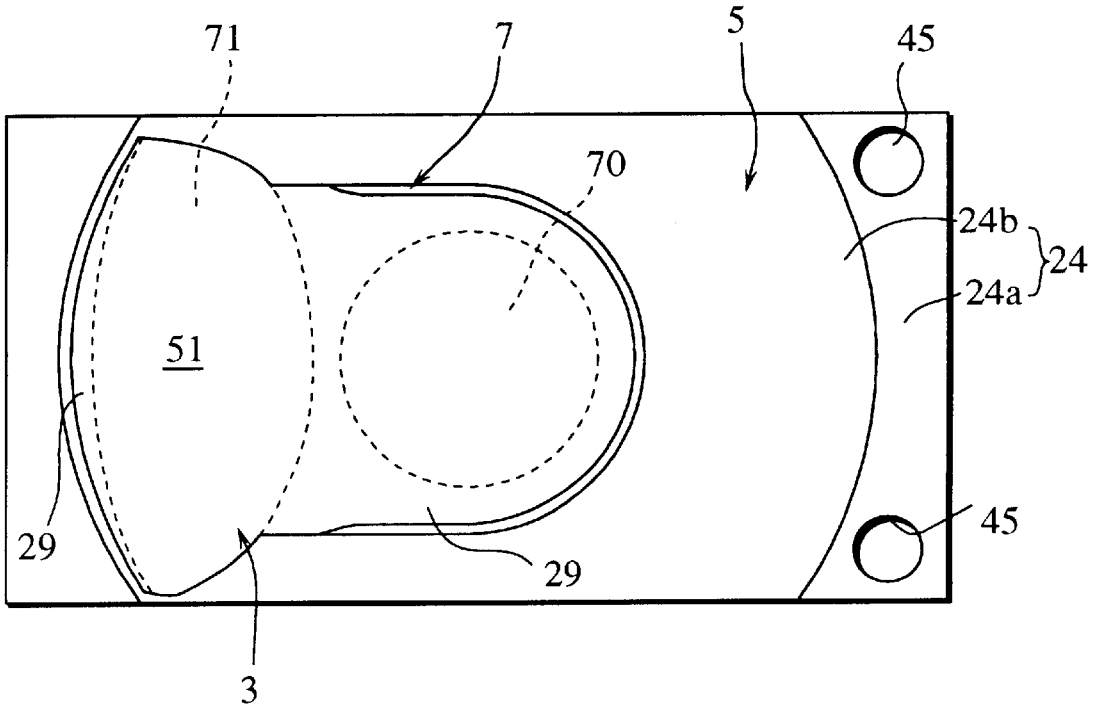
FIG. 38 is a top view of a molded product of amorphous metal after the press molding.

FIG. 37 and FIG. 38 show a state wherein the molten metal extending from the first concave portion 70 of the cavity portion 7, becomes a molded product 3 of amorphous metal in the predetermined configuration upon cooling solidification. The molten metal over the melting point raised on the first concave portion 70 is poured into the second concave portion 71 immediately, whereby the amount of the molten metal which flows back into the opposite side to the second concave portion 71 (the bushings 45 side) can be minimized because, as described above, the upper mold 4 is inclined and oscillated so as to bring the convex curved face 23 near to the first concave portion 70 side and then sequentially to the second concave portion 71 side. This effect is demonstrated by an inclination angle θ of from 1° to 15° of the upper mold 4 to the lower mold 5. In case the inclination angle θ is less than 1°, the amount of the molten metal flowing back to the opposite side into the second concave portion 71 becomes excessive, and the molded product may be defective for a reduced amount of the molten metal flowing into the second concave portion 71. Even if the inclination angle θ is more than 15°, the above-described effect is not further improved. Further, for pouring the molten metal 28 having a temperature over the melting point which is raised in the first concave portion 70 to flow into the second concave portion 71 smoothly, it is preferable that the upper mold 4 has a smooth convex curved face 23 or a plane 41 (refer to FIG. 42), and especially, the smooth convex curved face 23 is desirable.

And, the molded product 3 of a predetermined thickness is certainly obtained because the press metal mold 6 has no engagement portion, so that the molten metal is not prevented from flowing during the press by the press metal mold 6, and the closing is not interrupted. Thus, the press metal mold is not damaged by the flash 29, and the press metal mold 6 has high durability. In the molded product of amorphous metal, the flash 29 is a part which is not a product portion (a final configuration portion 51) formed by the second concave portion 71 for final molding.

The molded product 3 of thin plate shape (the final configuration portion 51) made by the method described above is a molded product of amorphous metal (amorphous alloy) that is cooled and solidified uniformly, not mixed with a crystal phase caused by non-uniform solidification and non-uniform nucleation, and excellent in strength characteristics, such as high strength, and high toughness without defects, such as cold shut, because the molten metal having a temperature of over the melting point is transformed into a predetermined configuration and cooled instantaneously. That is to say, after the fusing of the metal material, the obtained molten metal is pressed and transformed without there being contacts of cooling surfaces of the molten metal under the melting point by molten metal over the melting point.

In other words, as described with reference to FIG. 33, the metal material 26 contacts the first concave portion 70. Because lower mold 5 is usually cooled so as not to generate melting and damage in the fusing process of the metal material 26, a bottom face side of the metal material 26 touching the first concave portion 70 may not be sufficiently fused from heat loss, so that a part touching the first concave portion 70 (the above-mentioned bottom face side) may remain in crystal phase without forming an amorphous phase even after the press molding. In the method for manufacturing a molded product of amorphous metal of the present invention, however, the molded product of amorphous metal 3 (the final configuration portion 51) without crystal phase can be made, because the raised part of the molten metal 28 is poured into the second concave portion 71 and is rapidly cooled instantaneously leaving a part of the molten metal 28 touching the first concave portion 70.

Figure 39A:
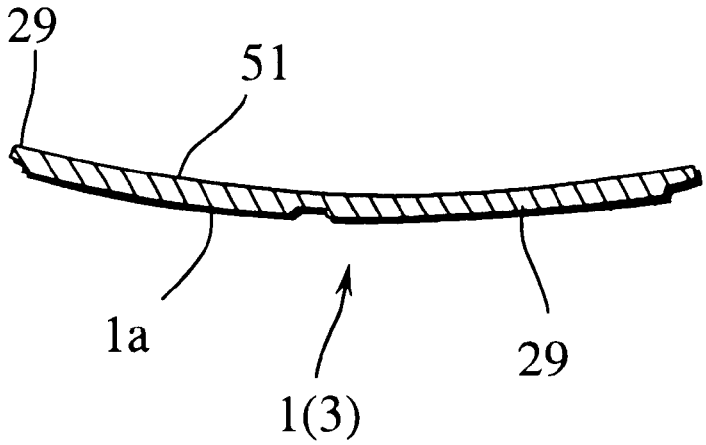
FIG. 39A is a cross-sectional view showing a state before finishing of a molded product of amorphous metal of the present invention.
Figure 39B:
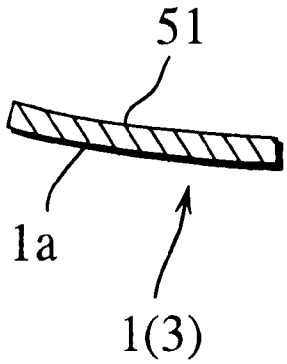
FIG. 39B is a cross-sectional view showing a product state of a molded product of amorphous metal of the present invention.

FIG. 39A shows the above-described molded product 3 (the partially fabricated product) taken out of the press metal mold 6. The molded product 3 is, in this preferred embodiment, a face body 1 (the partially fabricated product) of a golf club head. The face body 1 has the flash 29 on the final configuration portion 51, the flash 29 is cut, and the face body 1 is finished as a product, as shown in FIG. 39B. Reference character 1*a* represents a face of the face body 1.

And, as described with reference to FIG. 28 through FIG. 31, the face body 1 of amorphous metal as the final configuration shown in FIG. 39B does not need working for bulge adjustment, since the radius of curvature of the second convex portion 71 of the lower mold 5 forming the face 1*a* is arranged to be 5 inches to 100 inches, and the radius of curvature of the upper mold 4 is arranged to be more than 5 inches in case of a wood-type golf club head. If the radius of curvature of the lower mold 5 is less than 5 inches, in case of a wood-type golf club, after-working, such as cutting and polishing for diminishing the bulge of the face body 1 becomes necessary, and if the radius of curvature of the lower mold 5 is more than 100 inches, after-working for adding the bulge becomes necessary. Further, in case of an iron-type golf club head, the face body 1 may be planar. In this case, the configuration of the second concave portion 71 is a curved face of which the radius of curvature is more than 5 inches or a plane.

Therefore, the face body 1 of amorphous metal of the present invention formed in the final configuration as described above, is used for a hollow golf club head (a metal head) 2 of wood-type, as shown in FIG. 7 and FIG. 8, and for a golf club head 2 of iron-type, as shown in FIG. 9 and FIG. 10.

The golf club provided with the club head 2 having the face body 1 of amorphous metal made as described above can keep stable repeatability in ball hittings for the stably manufactured face body 1 which has unvarying characteristics, excellent strength characteristics, such as high strength and high toughness, and good yield and reduced production cost. Consequently, excellent characteristics, such as long flying distance, directionality, impact characteristics, strength, toughness, etc. are demonstrated.

Figure 40:
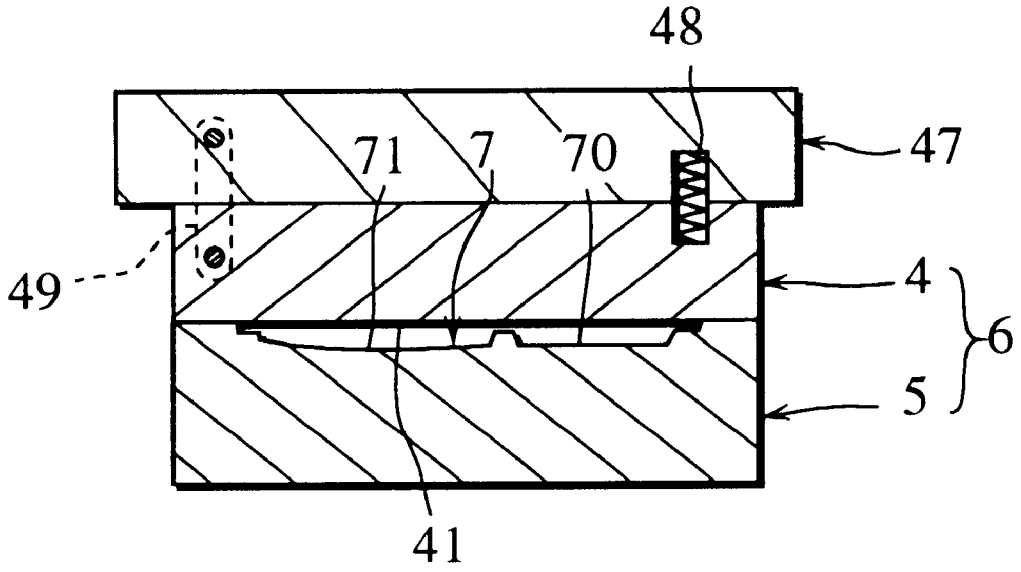
FIG. 40 is a cross-sectional front view showing another configuration of the press metal mold.
Figure 41:
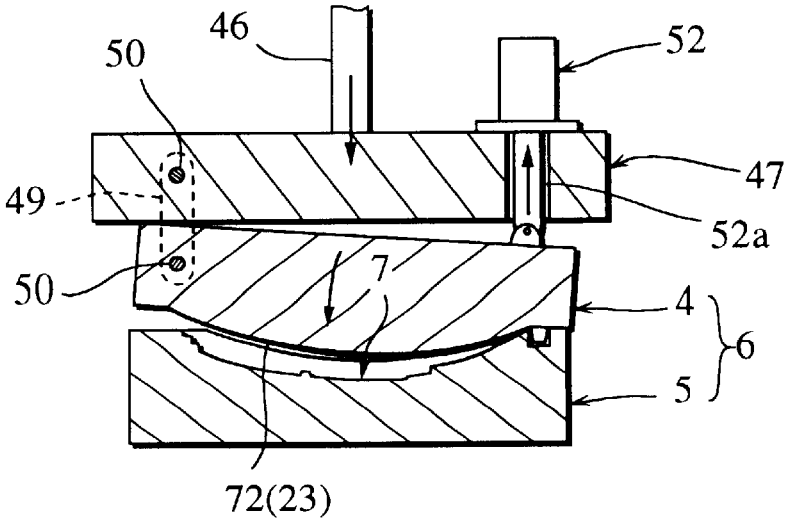
FIG. 41 is a cross-sectional front view showing a second oscillation press mechanism which holds the upper mold with an inclination.

Next, other configurations of the above-described press metal mold 6 will be described. In the press metal mold 6 shown in FIG. 40, the cavity portion 7 of the lower mold 5 has the first concave portion 70 of plane configuration and the second concave portion 71 of curved face configuration, and the upper mold 4 is a smooth face having the plane 41. The second concave portion 71 of the lower mold 5, namely, a contact lower mold portion that the molded product of amorphous metal to be formed contacts directly, may be a plane or a convex curved face. A lower face of the upper mold 4 facing the contact lower mold portion, namely, a contact upper mold portion that the molded product of amorphous metal to be formed contacts directly, may be composed of a concave curved face. And it is especially preferable that the contact upper mold portion is a concave curved face of which the radius of curvature is 5 inches to 100 inches. In this case, the above-mentioned contact lower mold portion of the lower mold 5 is preferably formed as a convex curved face of which the radius of curvature is more than 5 inches or a plane. And it is especially preferable that the contact upper mold portion is formed as a convex curved face of which the radius of curvature is 5 inches to 100 inches. As described above, the working effect described with reference to FIG. 21 is achieved in that the contact upper mold portion is composed of a concave curved face. That is to say, the upper portion of the molten metal 28 can retain higher temperature in comparison with the lower portion of the molten metal 28 touching the cooled lower mold 5 before the press molding, the upper portion of the molten metal 28 pressed by the contact upper mold portion of the upper mold 4 is more rapidly cooled than the lower portion of the molten metal 28 in the press molding, and good amorphous phase is formed on a contact face (convex curved face) side of the molded product touching the contact upper mold portion of concave curved face. Therefore, a face body 1 of a golf club head (molded product of amorphous metal) in which well-formed amorphous phase is disposed on a face 1*a* side which directly hits a golf ball can be made in that the contact upper mold portion is composed of a concave curved face.

FIG. 41 through FIG. 45 show another oscillation press mechanism that oscillates and presses the upper mold 4 held with an inclination to the lower mold 5. First, in a mechanism shown in FIG. 41, a left side of the upper mold 4 is connected with a left side of the attachment portion 47 through oscillating pieces 49 and supporting shafts 50, an expansion cylinder 52 is attached on a right side of the attachment member 47, and a rod 52*a* of the expansion cylinder 52 is passed through the attachment portion 47 and connected to the upper mold 4. The upper mold 4 is adjusted to be inclined with a predetermined inclination angle by expansion and contraction of the rod 52*a*. In closing of the metal mold, contracting speed of the rod 52*a* and descending speed of the upper mold 4 are arranged to be the same to oscillate the upper mold 4 from inclined to parallel to the lower mold 5, and superpose the upper mold 4 on the lower mold 5.

Figure 42:
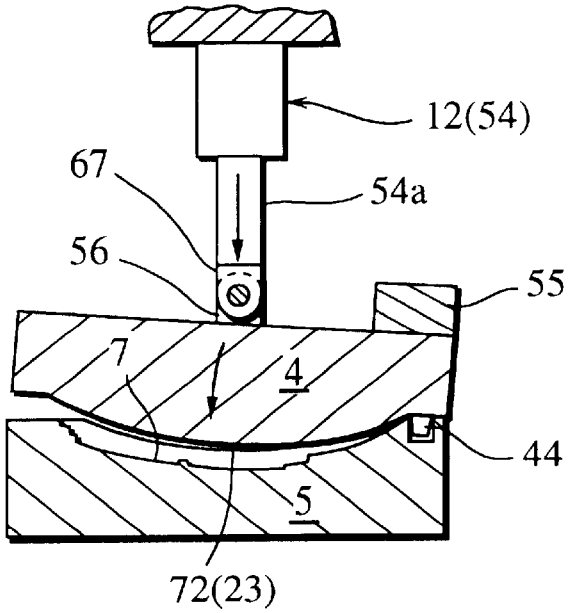
FIG. 42 is a cross-sectional front view showing a third oscillation press mechanism.

Second, in a mechanism shown in FIG. 42, an attachment piece 56 on the upper mold 4 is attached to a lower end of a rod 54*a* of the upper mold moving mechanism 12 (an expansion cylinder 54, for example), a weight 55 is attached on the tapered knock pins 44 side to incline the upper mold 4 with the center of gravity of the upper mold 4 moved to the right side. In a suspended state of the upper mold 4, it is preferable to attach a stopper piece to the attachment piece 56 of the upper mold 4 as to stop an end 67 of the rod 54*a* for maintenance of a predetermined inclination angle of the upper mold 4.

Figure 43A:
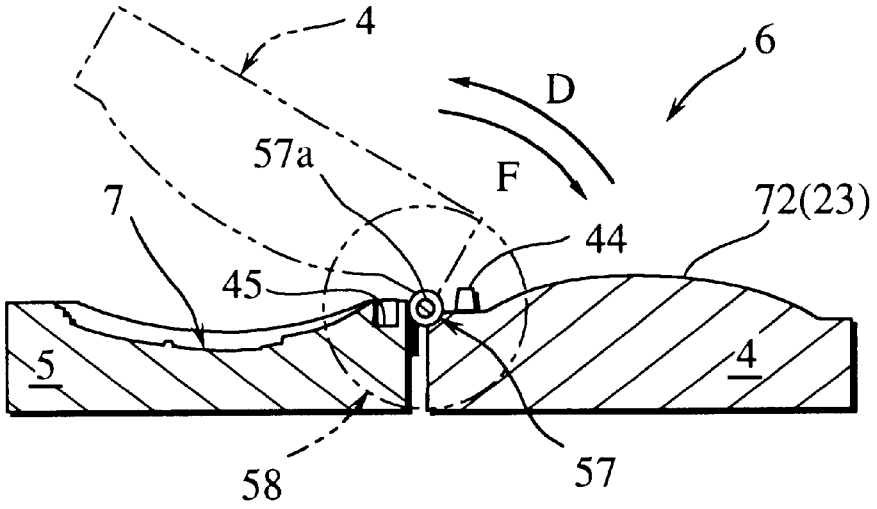
FIG. 43A is a first work-explanatory view showing a fourth oscillation press mechanism.
Figure 43B:
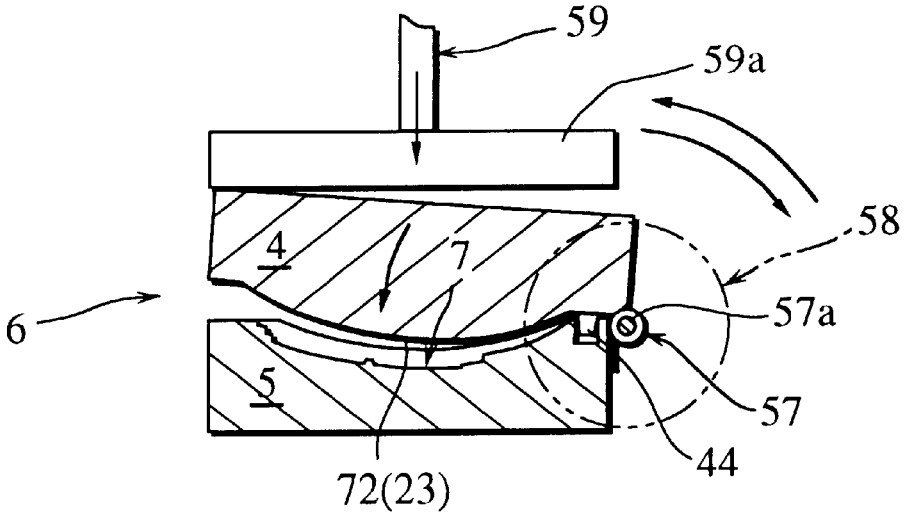
FIG. 43B is a second work-explanatory view showing the fourth oscillation press mechanism.

Third, in a mechanism shown in FIG. 43A, a corner portion of the tapered knock pins 44 side of the upper mold 4 is connected to a corner portion of the bushings 45 side of the lower mold 5 through a hinged portion 57 as to be oscillatable, and the upper mold 4 is integrally oscillatable with an oscillation shaft 57*a* of the hinged portion 57. And, the oscillation shaft 57*a* is connected to an oscillation driving mechanism 58 (shown by an imaginary line), and the upper mold 4 is oscillated (in a direction shown by arrow D and arrow F), for example, for 180° by rotating the oscillation shaft 57*a* in forward and reverse directions with the oscillation driving mechanism 58. Further, as shown in FIG. 43B, an elevation press mechanism 59, which presses the upper mold 4 with a pressure plate 59*a* in closing of the metal mold, is provided. As the oscillation driving mechanism 58, for example, a rotary cylinder, an oscillating motor, etc. are used.

Figure 44A:
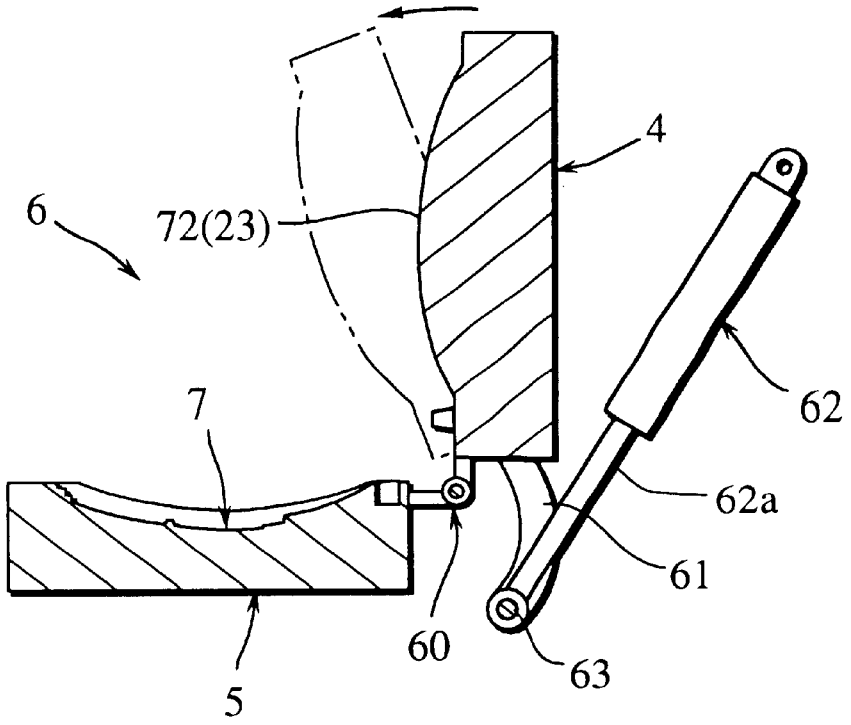
FIG. 44A is a first work-explanatory view showing a fifth oscillation press mechanism.
Figure 44B:
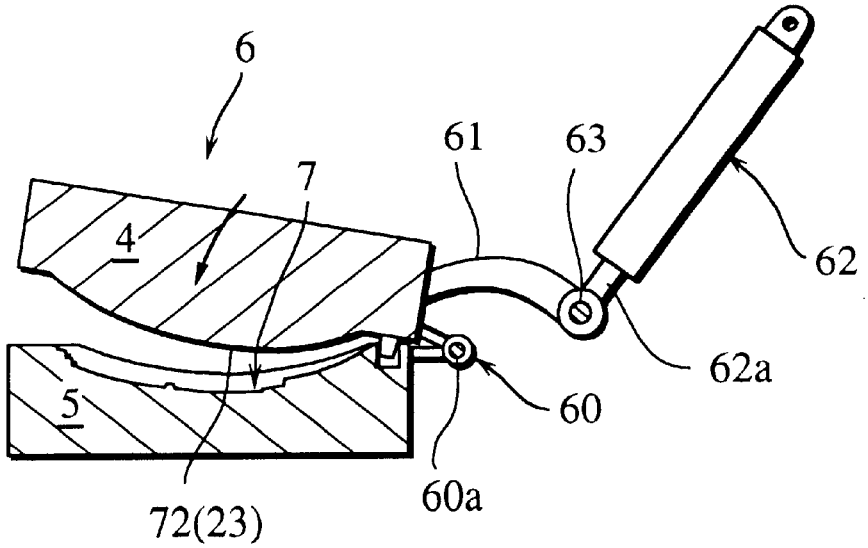
FIG. 44B is a second work-explanatory view showing the fifth oscillation press mechanism.

Fourth, in a mechanism shown in FIG. 44A, the upper mold 4 and the lower mold 5 are connected through a hinged portion 60 as to be oscillatable, and an end of a rod 62*a* of an expansion cylinder 62 is attached to an oscillation arm 61 protruding from a part of the upper mold 4 through a connecting shaft 63. An end of the expansion cylinder 62 is attached to a fixation member (not shown in the figures) as to be oscillatable. In closing of the metal mold, as shown in FIG. 44B, the oscillation arm 61 is pulled toward the expansion cylinder 62 side by contraction of the expansion cylinder 62, the inclined upper mold 4 is oscillated around the shaft 60*a* of the hinged portion 60 and becomes parallel to the lower mold 5, and placed on the lower mold 5. The expansion cylinder 62 pushes the upper mold 4 at the same time. The upper mold 4 oscillates in an opening direction when the expansion cylinder 62 extends.

Figure 45:
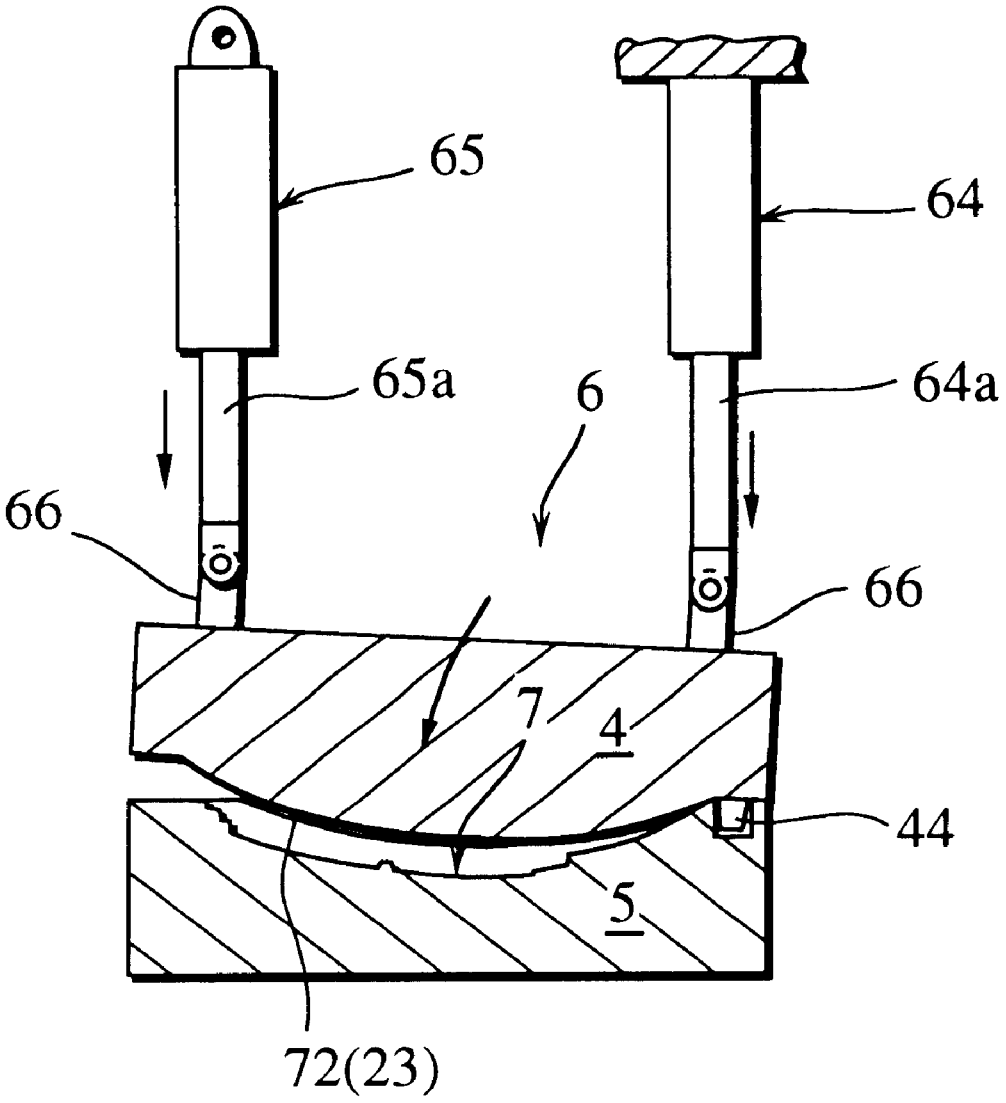
FIG. 45 is a cross-sectional front view showing a sixth oscillation press mechanism.
Figure 46A:
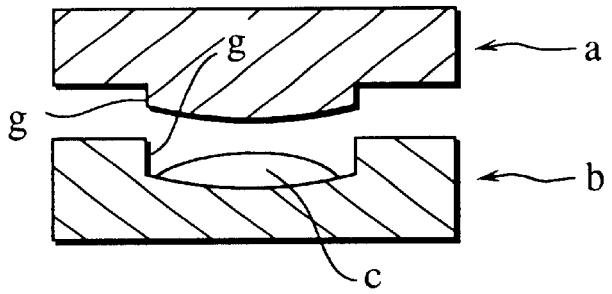
Fig.46A (PRIOR ART)
FIG. 46A is a first work-explanatory view showing a conventional example.
Figure 46B:
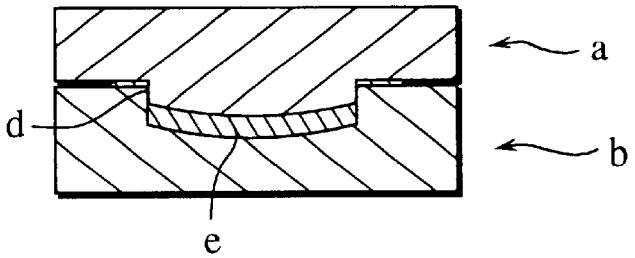
Fig.46B (PRIOR ART)
FIG. 46B is a second work-explanatory view showing the conventional example.
Figure 47:
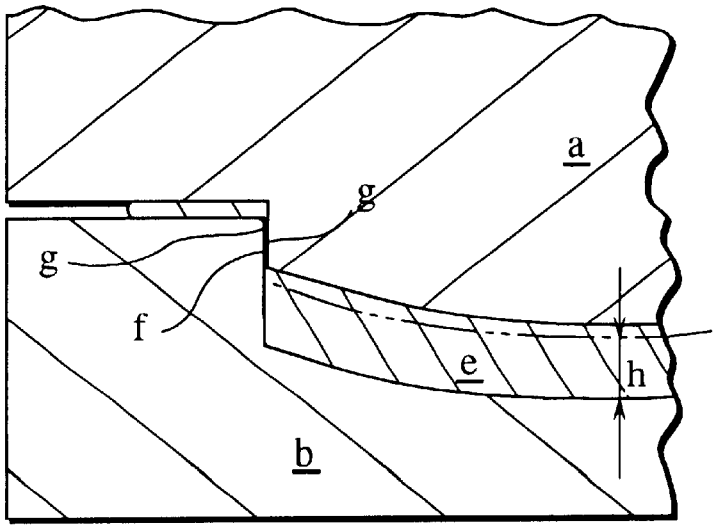
Fig.47 (PRIOR ART)
FIG. 47 is a cross-sectional view of an enlarged principal portion showing an imperfect closed state of a press metal mold.

Fifth, in the press metal mold 6 shown in FIG. 45, an attachment piece 66 on the tapered knock pins 44 side (right side) of the upper mold 4 is connected with a lower end of a rod 64*a* of a fixed first expansion cylinder 64, and another attachment piece 66 on the left side of the upper mold 4 is connected with a lower end of a rod 65*a* of an oscillatable second expansion cylinder 65. In a suspended state of the upper mold 4, the upper mold 4 is kept to be inclined with a predetermined inclination angle by adjustment of the first expansion cylinder 64 and the second expansion cylinder 65. In closing of the metal mold, the upper mold 4 is descended keeping the inclination angle by expansion of the first expansion cylinder 64 and the second expansion cylinder 65 at the same speed, and then, the first and second expansion cylinders 64 and 65 are controlled as to oscillate the upper mold 4 from inclined to parallel to the lower mold 5, and places the upper mold 4 on the lower mold 5.

In these press metal molds 6, which are not restricted to the above-described preferred embodiments, the upper mold 4 and the lower mold 5 are relatively inclined each other. That is to say, in an elevated state of the upper mold 4, the upper mold 4 is kept to be inclined, and the lower mold 5 is kept to be horizontal. And, the upper mold 4 is descended to press the lower mold 5, oscillated from inclined to horizontal to the lower mold 5, superposed on the lower mold 5, and the metal mold is closed thereby.

The present invention is not restricted to the preferred embodiments described above. For example, in the method for manufacturing the molded product of amorphous metal, number of the molded product 3 of amorphous metal (the face body 1) made at a time may be not only one, but also plural. And, the predetermined configuration in the present invention may be a configuration of single or plural (undetached) molded products, and may be not only a configuration of the completely finished molded product 3 (the face body 1), but also a configuration needs to be worked with simple workings, for example, finishing such as flash removal.

And, as the high energy heat source that fuses the metal material, not being restricted to a particular kind of equipment, for example, high frequency heat source, arc heat source, plasma heat source, electronic beam, laser beam, etc. are representative. And, single or plural units of these heat sources may be applied to the lower mold 5 of the press metal mold 6.

According to the molded product of amorphous metal relating to the present invention, it is possible to obtain a molded product of amorphous metal excellent in strength, toughness, and impact resistance, widely applicable to structural materials, etc. in which mechanical strength is required, for the molded product is bulk of relatively large mass, and relatively long in horizontal direction.

And, the face body 1 excellent in strength, toughness, and impact resistance can be obtained as bulk. A golf club head provided with this face body 1 can keep stable repeatability in ball hittings for the face 1*a* having especially high strength characteristics, demonstrate excellent characteristics such as long flying distance, directionality, impact characteristics, strength, toughness, etc. uniformly, without variation. Moreover, a face body 1, in which well-formed amorphous phase is disposed on the face la side that directly hits a golf ball, can be obtained.

Further, the molded product of amorphous metal (amorphous alloy) that is cooled and solidified uniformly, not mixed with crystal phase caused by non-uniform solidification and non-uniform nucleation, and excellent in strength characteristics, such as high strength and high toughness, without defects such as cold shut, can be obtained. Because the molten metal of a temperature over the melting point is transformed into a predetermined configuration, cooled instantaneously and rapidly solidified the molded product of amorphous metal can be produced by a simple production process with good repeatability instantaneously.

And, the press metal mold 6 does not have engagement portions, and closing of the metal mold is not prevented, unlike a conventional apparatus in which excessive molten metal flows into an aperture between an upper mold and a lower mold to be cooled and solidified, whereby the mold can be damaged by the solidified metal and, when molten metal flows into the damaged aperture "galling" is generated. Therefore, a molded product of amorphous metal in a predetermined configuration and a predetermined thickness can be obtained, and the metal mold has high durability.

According to the molded product of amorphous metal relating to the present invention, the molten metal 28 hardly flows (extends) when the metal material 26 placed on the cavity portion 7 of the lower mold 5 is fused by the high energy heat source, and heat energy from the high energy heat source can be effectively thrown on the metal material 26. Therefore, when a molded product of amorphous metal is made as the face body 1 of a golf club head, after-working for adjusting the bulge of the face body 1, such as cutting and polishing, is unnecessary because the molded product of amorphous metal having a lightly curved surface or a plane surface can be formed. Further, closing of the metal mold becomes smooth (i.e., not prevented), and a molded product of amorphous metal of a predetermined thickness is certainly obtained, because excessive molten metal 28 is sufficiently absorbed by the gap 25 formed beforehand on the press metal mold 6. And, the flash 29 can be easily cut.

Further, according to the molded product of amorphous metal relating to the present invention, the face body 1 of a golf club head is effectively made. That is to say, a part of the metal material 26 touching the lower mold 5 may not be sufficiently fused for the lower mold 5 to take the heat, and a concave curved face side of the molded product of amorphous metal after the molding may become crystal phase. Even if the crystal phase is generated, the part of crystal phase can be intentionally disposed on the reverse side of the face body 1 (opposite side to the face 1*a*), and an amorphous phase can be disposed on the face 1*a* side where high strength characteristics are required. Therefore, the face body 1 of amorphous metal of which face 1*a* for hitting a golf ball directly is excellent in strength, toughness, impact resistance, etc. can be obtained.

And, when the metal material 26 placed on the cavity portion 7 of the lower mold 5 is fused by the high energy heat source, the molten metal 28 stays (being kept spherical by its surface tension) at the concave portion 69 and does not flow to lower position of the periphery of the cavity portion 7. Therefore, heat energy from the high energy heat source can be effectively thrown on the molten metal 28 gathered on a central portion of the cavity portion 7, molding stability by the press metal mold 6 is improved, and high quality products are stably supplied. And, conveniently, in case that the molded product of amorphous metal is made as the face body 1 of a golf club head, a convex portion formed by the concave portion 69 of the lower mold 5 is unnecessary to be removed by cutting and polishing, because the convex portion is on the opposite side to the face 1*a*.

Further, a mechanism for keeping the upper mold 4 inclined and oscillating and pushing the upper mold 4 to the lower mold 5 (the oscillation press mechanism) can be relatively easily made.

Moreover, according to the molded product of amorphous metal relating to the present invention, when the metal material 26 is fused, the obtained molten metal 28 is gathered in the first concave portion 70, and heat energy from the high energy heat source is effectively thrown on the molten metal 28 having a temperature. That is to say, the molten metal 28 over the melting point does not flow out of the first concave portion 70 before closing of the metal mold. And, a part of the molten metal 28 raising in the first concave portion 70 is poured into the second concave portion 71 instantaneously by the closing of the metal mold, and the molded product of amorphous metal formed by the second concave portion 71 for final molding becomes excellent in strength characteristics, such as high strength, high toughness, etc., not mixed with crystal phase caused by non-uniform solidification and non-uniform nucleation, and without defection, such as cold shut. In other words, although a part of the molten metal 28 touching the first concave portion 70 may not be sufficiently fused as the lower mold 5 takes the heat, and may become crystal phase after the molding, the molded product of amorphous metal in the final configuration is an amorphous alloy having high strength characteristics without a crystal phase, because a raising part of the molten metal 28 not touching the first concave portion 70 is formed in the second concave portion 71.

And, in the press molding, the molten metal 28 having a temperature over the melting point raising in the first concave portion TO can be rapidly poured into the second concave portion 71, the amount of the molten metal 28 flowing to the opposite side to the second concave portion 71 is reduced, and amount of the flash 29 can be reduced thereby.

While preferred embodiments of the present invention have been described in this specification, it is to be understood that the invention is illustrative and not restrictive, because various changes are possible within the spirit and the indispensable features.

What is claimed is:

1. A molded amorphous metal product as a face body of a golf club head comprising a body substantially devoid of crystalline structure caused by non-uniform solidification and non-uniform nucleation and having a formed shape produced by the method involving fusing, by means of a high energy heat source, an amount of metal material in a lower mold of a press metal mold having an upper mold, in which a contact portion of said upper mold that the molded amorphous metal product directly contacts in a convex curved face of which a radius of curvature is from about 5 to about 100 inches, and said lower mold which, when pressed together with said upper mold, cooperates with said upper mold to provide a cavity having a formed shape and a gap in communication with said cavity to receive excess pressed metal from the filled cavity, and forming, when simultaneously cooling upon molding, said body and flash, and removing said flash leaving said body substantially devoid of crystalline structure.

2. The molded amorphous metal product as set forth in claim 1 including a smooth convex curved surface produced in said press metal mold with said lower mold having a smooth concave curved face.

3. The molded product of amorphous metal product as set forth in claim 2, wherein a contact face of the molded product touching the upper mold is a face intended for hitting a golf ball directly.

4. The molded amorphous metal product as set forth in claim 2 wherein the upper mold and the lower mold have been relatively oscillated from an inclined state and superposed in parallel with respect to each other.

5. A molded amorphous metal product as a face body of a golf club head formed in a configuration of the face body comprising a composition made by that a metal material is placed on a lower mold of a press metal mold having an upper mold, in which a contact portion of said upper mold that the molded amorphous metal product directly contacts is a convex curved face of which a radius of curvature is from about 5 to about 100 inches, and said lower mold without engagement portions fitting each other, the metal material is fused by a high energy heat source which can fuse the metal material to obtain molten metal, the obtained molten metal over a melting point is pressed between the upper mold and the lower mold thereby transforming the metal into the configuration of the face body, and the molten metal is cooled to form said molded product at a cooling rate whereby formation of crystalline structure in said metal is substantially prevented both simultaneous to and after the transformation.

6. The molded amorphous metal product as set forth in claim 5 including a smooth convex curved surface produced in said press metal mold with said upper mold having a smooth concave curved face.

7. The molded amorphous metal product as set forth in claim 6, wherein the upper mold and the lower mold have been relatively oscillated from an inclined state and superposed in parallel with respect to each other.

8. The molded amorphous metal product as set forth in claim 6, wherein a contact face of the molded product touching the upper mold is a face intended for hitting a golfball directly.

* * * * *